US009280980B2

(12) United States Patent
Grancharov et al.

(10) Patent No.: US 9,280,980 B2
(45) Date of Patent: Mar. 8, 2016

(54) EFFICIENT ENCODING/DECODING OF AUDIO SIGNALS

(75) Inventors: Volodya Grancharov, Solna (SE); Erik Norvell, Stockholm (SE); Sigurdur Sverrisson, Kungsängen (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 190 days.

(21) Appl. No.: 13/982,515

(22) PCT Filed: Feb. 9, 2011

(86) PCT No.: PCT/SE2011/050146

§ 371 (c)(1), (2), (4) Date: Jul. 30, 2013

(87) PCT Pub. No.: WO2012/108798

PCT Pub. Date: Aug. 16, 2012

(65) Prior Publication Data

US 2013/0317811 A1 Nov. 28, 2013

(51) Int. Cl.

*G10L 19/00* (2013.01)
*G10L 19/12* (2013.01)
*G10L 19/02* (2013.01)
(Continued)

(52) U.S. Cl.

CPC ..... *G10L 19/12* (2013.01); *G10L 19/0204* (2013.01); *G10L 21/0388* (2013.01); *G10L 19/0212* (2013.01); *G10L 19/24* (2013.01); *G10L 2019/0008* (2013.01)

(58) Field of Classification Search

CPC ... G10L 19/02; G10L 19/008; G10L 19/0204; G10L 19/025; G10L 19/04; G10L 19/0017; G10L 19/0212; G10L 19/093; G10L 19/173; G10L 19/18; G10L 19/24; G10L 19/035; G10L 19/26

USPC ..... 704/230, 229, 200.1, 500–504, 205, 704/219, 225, 226, 224; 381/94.3, 94.5, 98

See application file for complete search history.

(56) References Cited

U.S. PATENT DOCUMENTS 5,621,856 A * 4/1997 Akagiri ..... 704/200.1
7,272,556 B1 * 9/2007 Aguilar et al. ..... 704/230
8,352,279 B2 * 1/2013 Gao ..... 704/500
(Continued)

FOREIGN PATENT DOCUMENTS

EP 0878790 A1 11/1998
JP 01233496 A 9/1989
(Continued)

*Primary Examiner* — Vijay B Chawan

(74) *Attorney, Agent, or Firm* — Murphy, Bilak & Homiller, PLLC

(57) ABSTRACT

A method for encoding of an audio signal comprises performing (214) of a transform of the audio signal. An energy offset is selected (216) for each of the first subbands. An energy measure of a first reference band within a low band of an encoding of a synthesis signal is obtained (212). The first high band is encoded (220) by providing quantization indices representing a respective scalar quantization of a spectrum envelope in the first subbands of the first high band relative to the energy measure of the first reference band by use of the selected energy offset. An encoder apparatus comprises means for carrying out the steps of the method. Corresponding decoder methods and apparatuses are also described.

40 Claims, 19 Drawing Sheets

(51) Int. Cl.
*G10L 21/0388* (2013.01)
*G10L 19/24* (2013.01)

(56) References Cited

U.S. PATENT DOCUMENTS

| | | | | |
|---|---|---|---|---|
| 2004/0019492 | A1 | 1/2004 | Tucker et al. | |
| 2005/0165611 | A1 | 7/2005 | Mehrotra et al. | |
| 2008/0027718 | A1 | 1/2008 | Krishnan et al. | |
| 2008/0052068 | A1* | 2/2008 | Aguilar et al. | 704/230 |
| 2010/0063812 | A1* | 3/2010 | Gao | 704/230 |
| 2010/0286990 | A1* | 11/2010 | Biswas et al. | 704/500 |
| 2011/0238425 | A1* | 9/2011 | Neuendorf et al. | 704/500 |
| 2013/0030797 | A1* | 1/2013 | Gao | 704/205 |
| 2013/0096930 | A1* | 4/2013 | Neuendorf et al. | 704/500 |

FOREIGN PATENT DOCUMENTS

| | | | |
|---|---|---|---|
| JP | 09172376 | A | 6/1997 |
| JP | 2001343997 | A | 12/2001 |
| WO | 2004027998 | A2 | 4/2004 |
| WO | 2006048203 | A1 | 5/2006 |
| WO | 2009059632 | A1 | 5/2009 |
| WO | 2010042024 | A1 | 4/2010 |

* cited by examiner $E_1^{ref}$
101
111
112
FREQ.

$E_1^{ref}$
102
111
112
FREQ.

$E_1^{ref}$
103
113
111
112
FREQ.

EFFICIENT ENCODING/DECODING OF AUDIO SIGNALS

TECHNICAL FIELD

The present invention relates in general to encoding/decoding of audio signals, an in particular to methods and devices for efficient low bit-rate audio encoding/decoding.

BACKGROUND

When audio signals are to be transmitted and/or stored, a standard approach today is to code the audio signals into a digital representation according to different schemes. In order to save storage and/or transmission capacity, it is a general wish to reduce the size of the digital representation needed to allow reconstruction of the audio signals with sufficient quality. The trade-off between size of the coded signal and signal quality depends on the actual application.

There is a large variety of different coding principles. Transform based audio coders compress audio signals by quantizing the transform coefficients. Such coding thus operates in a transformed frequency domain. Transform based audio coders are efficient concerning moderate and high-bitrate coding of general audio but are not very efficient concerning low-bitrate coding of speech.

Code-Excited Linear Prediction (CELP) codecs, e.g. Algebraic Code-Excited Linear Prediction (ACELP) codecs, are very efficient at low bit-rate speech coding. The CELP speech synthesis model uses analysis-by-synthesis coding of the speech signal of interest. The ACELP codec can achieve high-quality at 8-12 kbit/s. However, signal features having high-frequency components are generally not modeled equally well.

One approach used for reducing the required bit-rate is to use BandWidth Extension (BWE). The main idea behind BWE is that part of an audio signal is not transmitted, but reconstructed (estimated) at the decoder from the received signal components. A combination of a CELP coding of a signal sampled by a low sampling rate and BWE is one solution that is discussed.

On the other hand BWE is more efficiently performed in a transformed domain, e.g. a Modified Discrete Cosine Transform (MDCT) domain. The reason for this is that the perceptually important signal features in the BWE region is more efficiently modeled in a frequency domain representation.

A problem with prior art codec systems is thus to find BWE encoding schemes that are efficient for all types of audio signals.

SUMMARY

A general object of the present invention is to provide methods and encoder and decoder arrangements that allow for an efficient low bit-rate encoding/decoding for most types of audio signals.

This object is achieved by methods and arrangements according to the enclosed independent claims. Preferred embodiments are defined in the dependent claims.

In general words, in a first aspect, a method for encoding of an audio signal comprises obtaining of a low band synthesis signal of an encoding of the audio signal. A first energy measure of a first reference band within a low band in the low band synthesis signal is obtained. A transform of the audio signal into a transform domain is performed. An energy offset is selected from a set of at least two predetermined energy offsets for each of a plurality of first subbands of a first high band of the audio signal in the transform domain. The first high band is situated at higher frequencies than the low band. The first high band is encoded. The encoding comprises providing of a first set of quantization indices representing a respective scalar quantization of a spectrum envelope in the plurality of first subbands of the first high band relative to the first energy measure. The quantization indices of the first set of quantization indices are given with a respective selected energy offset. The encoding of the first high band also comprises providing of a parameter defining the used energy offset. A second energy measure of a second reference band within the low band in the low band synthesis signal is obtained. A second high band of the audio signal in the transform domain is encoded. The second high band is situated in frequency between the low band and the first high band. The encoding of the second high band comprises providing of a second set of quantization indices representing a respective scalar quantization of a spectrum envelope in a plurality of second subbands of the second high band relative to the second energy measure.

In a second aspect, a method for decoding of an audio signal comprises receiving of an encoding of the audio signal. The encoding represents a first set of quantization indices of a spectrum envelope in a plurality of first subbands of a first high band of the audio signal. The first set of quantization indices represents energies relative to a first energy measure. A low band synthesis signal of an encoding of the audio signal is obtained. The first energy measure is obtained as an energy measure of a first reference band within a low band in the low band synthesis signal. The first high band is situated at higher frequencies than the low band. The encoding further represents a parameter defining a used energy offset. An energy offset is selected from a set of at least two predetermined energy offsets for each of the first subbands. This selection is based on the parameter defining the used energy offset. A signal in a transform domain is reconstructed by determining a spectrum envelope in the first high band from the first set of quantization indices corresponding to the first subbands, by use of the so selected energy offset and the first energy measure, for each of the first subbands of the first high band. An inverse transform is performed into the audio signal, based on at least the reconstructed signal in the transform domain. The encoding further represents a second set of quantization indices of a spectrum envelope in a plurality of second subbands of a second high band. The second high band is situated in frequency between the low band and the first high band. The second set of quantization indices represents energies relative to a second energy measure. The second energy measure is obtained as an energy measure of a second reference band within the low band in the low band synthesis signal. The reconstructing of the signal in the transform domain further comprises determining of a spectrum envelope in the second high band from the second set of quantization indices corresponding to the second subbands by use of the second energy measure for each of the second subbands of the second high band.

In a third aspect, an encoder apparatus for encoding of an audio signal comprises a transform encoder, a selector, a synthesizer, an energy reference block and an encoder block. The transform encoder is configured for performing a transform of the audio signal into a transform domain. The selector is configured for selecting an energy offset from a set of at least two predetermined energy offsets for each of a plurality of first subbands of a first high band of the audio signal in the transform domain. The synthesizer is configured for obtaining a low band synthesis signal of an encoding of the audio signal. The energy reference block is connected to the synthesizer and configured for obtaining a first energy measure of a first reference band within a low band in the low band synthesis signal. The first high band is situated at higher frequencies than the low band. The encoder block is connected to the selector and the energy reference block. The encoder block is configured for encoding the first high band. The encoding of the first high band comprises providing of a first set of quantization indices representing a respective scalar quantization of a spectrum envelope in the plurality of first subbands of the first high band relative to the first energy measure. The quantization indices of the first set of quantization indices are given with a respective selected energy offset. The encoding of the first high band further comprises providing of a parameter defining the used energy offset. The energy reference block is further configured for obtaining a second energy measure of a second reference band within the low band of the low band synthesis signal. The encoder block is further configured for encoding a second high band of the audio signal in the transform domain. The second high band is situated in frequency between the low band and the first high band. The encoding of the second high band comprises providing of a second set of quantization indices representing a respective scalar quantization of a spectrum envelope in a plurality of second subbands of the second high band relative to the second energy measure.

In a fourth aspect, an audio encoder comprises an encoder apparatus according to the third aspect.

In a fifth aspect, a network node comprises an audio encoder according to the fourth aspect.

In a sixth aspect, a decoder apparatus for decoding of an audio signal comprises an input block, a synthesizer, an energy reference block, a selector, a reconstruction block and an inverse transform decoder. The input block is configured for receiving an encoding of the audio signal. The encoding represents a first set of quantization indices of a spectrum envelope in a plurality of first subbands of a first high band of the audio signal. The first set of quantization indices represents energies relative to a first energy measure. The synthesizer is configured for obtaining a low band synthesis signal of an encoding of the audio signal. The energy reference block is connected to the synthesizer and configured for obtaining the first energy measure as an energy measure of a first reference band within a low band in the low band synthesis signal. The first high band is situated at higher frequencies than the low band. The encoding further represents a parameter defining a used energy offset. The selector is connected to the input block. The selector is configured for selecting an energy offset from a set of at least two predetermined energy offsets for each of the first subbands based on the parameter defining the used energy offset. The reconstruction block is connected to the input block, the selector and the energy reference block. The reconstruction block is configured for reconstructing a signal in a transform domain by determining a spectrum envelope in the first high band from the first set of quantization indices corresponding to the first subbands by use of the selected energy offset and the first energy measure, for each of the first subbands of the first high band. The inverse transform decoder is connected to the reconstruction block. The inverse transform decoder is configured for performing an inverse transform into the audio signal based on at least the reconstructed signal in the transform domain. The encoding further represents a second set of quantization indices of a spectrum envelope in a plurality of second subbands of a second high band. The second high band is situated in frequency between the low band and the first high band. The second set of quantization indices represents energies relative to a second energy measure. The energy reference block is further configured for obtaining the second energy measure as an energy measure of a second reference band within the low band of the low band synthesis signal. The reconstruction block is further configured for determining of a spectrum envelope in the second high band from the second set of quantization indices corresponding to the second subbands by use of the second energy measure for each of the second subbands of the second high band.

In a seventh aspect, an audio decoder comprises a decoder apparatus according to the sixth aspect.

In an eighth aspect, a network node comprises an audio decoder according to the seventh aspect.

One advantage with the present invention is that the quality, measured in subjective listening tests, is increased compared to e.g. a pure ACELP encoding, with very low required additional bit-rate for BWE information. Further advantages are discussed in connection to the different embodiments described below.

BRIEF DESCRIPTION OF THE DRAWINGS

The invention, together with further objects and advantages thereof, may best be understood by making reference to the following description taken together with the accompanying drawings, in which.

DETAILED DESCRIPTION

Throughout the drawings, the same reference numbers are used for similar or corresponding elements.

The description will start with a description of the overall system, then describe examples presenting a part of the final solution before the final solution is presented.

Figure 1:
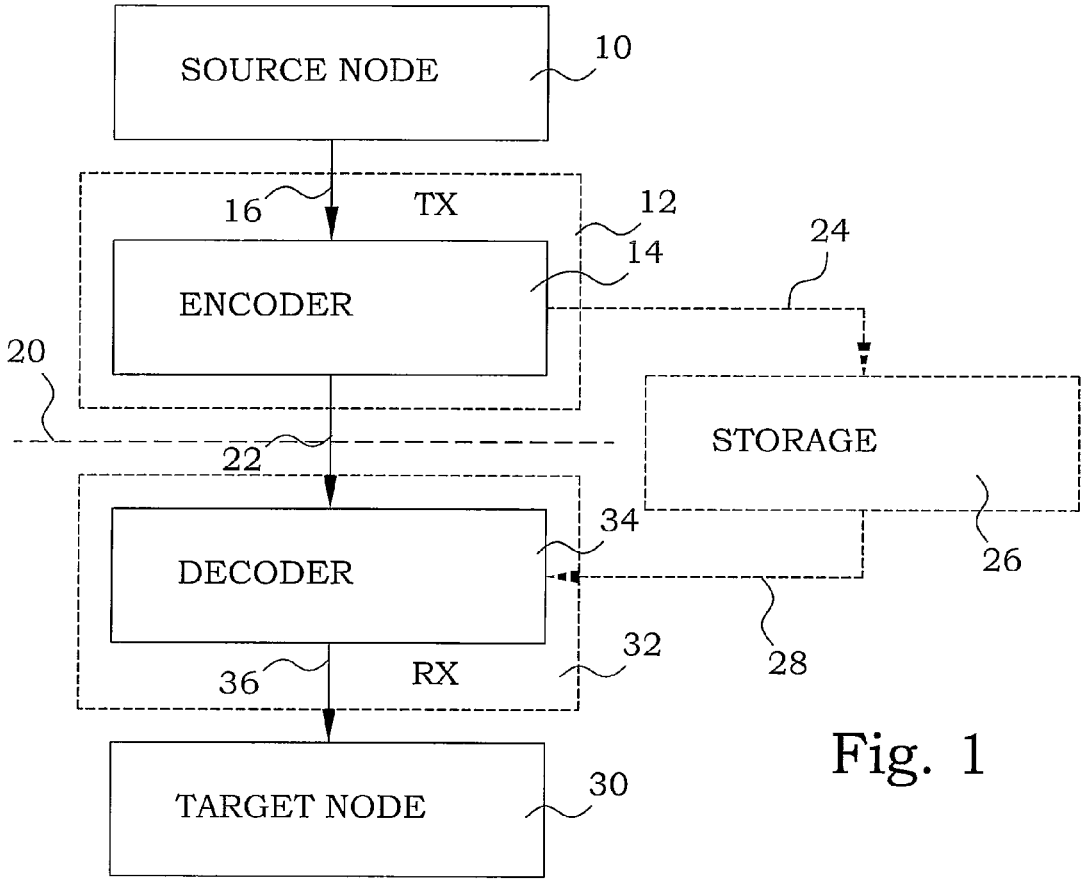
FIG. 1 is a schematic block diagram of an example of an audio system.

An example of a general audio system with a codec system is schematically illustrated in FIG. 1. An audio source node 10 gives rise to an audio signal 16. The audio signal 16 is handled in an audio encoder 14, which produces a binary flux 22 comprising data representing the audio signal 16. The audio encoder 14 is typically comprised in a transmitter 12. Such a transmitter may e.g. be a part of a communication network node. The audio encoder typically comprises one or several encoder apparatuses, as will be discussed further below. The binary flux 22 may be transmitted by the transmitter, as e.g. in the case of multimedia communication, over a transmission interface 20. Alternatively or complementary, the binary flux 22 can be recorded 24 into a storage 26, from which it can be retrieved 28 at a later occasion. The transmission arrangements may optionally also comprise some storing capacities. The binary flux 22 may also only be stored temporarily, just introducing a time delay in the utilization of the binary flux. When being used, the binary flux 22 is handled in an audio decoder 34. The audio decoder 34 is typically comprised in a receiver 32. Such a receiver may e.g. be a part of a communication network node. The audio decoder typically comprises one or several encoder apparatuses, as will be discussed further below. The decoder 34 produces an audio output 36 from the data comprised in the binary flux. Typically, the audio output 36 should resemble the original audio signal 16 as well as possible under certain constraints. The audio output is provided to a target node 30.

In many real-time applications, the time delay between the production of the original audio signal 16 and the produced audio output 36 is typically not allowed to exceed a certain time. If the transmission resources at the same time are limited, the available bit-rate is also typically low.

Figure 2A:
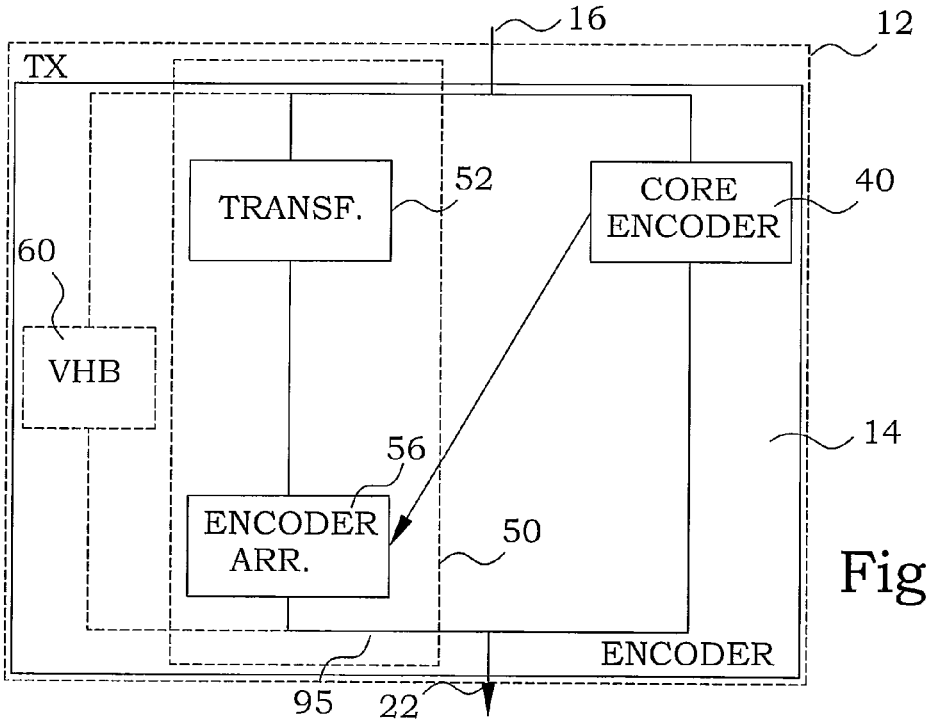
FIG. 2A is a schematic block diagram of an embodiment of an audio encoder.

FIG. 2A schematically illustrates an embodiment of an audio encoder 14 of a transmitter 12 as a block diagram. An audio signal 16 is provided at an input. The audio signal is provided to a core encoder 40, which performs an encoding of a part of the audio signal, e.g. of a low frequency part. This encoding constitutes the core part of the information sent to the decoding side. In the audio encoder 14, the audio signal is also provided to a transform encoder 52. The transform encoder 52 transforms the audio signal into a transform domain or equivalently frequency domain. At least a part of the audio signal is encoded by an encoder arrangement 56 in the transform domain. In the encoder arrangement 56 a spectrum envelope of the transform is quantized. A respective scalar quantization of the spectrum envelope is determined in a plurality of subbands in the transform domain of the audio signal. The quantized spectrum envelope, typically for a certain frequency band, is encoded into quantization indices. By utilizing information being available from the core encoder 40 or from the audio signal itself, this encoding of the quantized spectrum envelope can be performed more efficiently in terms of necessary bit-rate. Such encoding can then be utilized for BWE purposes. The encoding representing quantization indices of the spectrum envelope 95 is together with the core encoding parameters provided to the decoder side as the binary flux 22. The transform encoder 52 and the encoder arrangement 56 form an encoder apparatus 50 used for providing bandwidth expansion data for a certain frequency range. Optionally, also other types of bandwidth extension functionalities can be used together with this concept, e.g. as exemplified by a very high bandwidth extension encoder 60 in the figure.

Figure 2B:
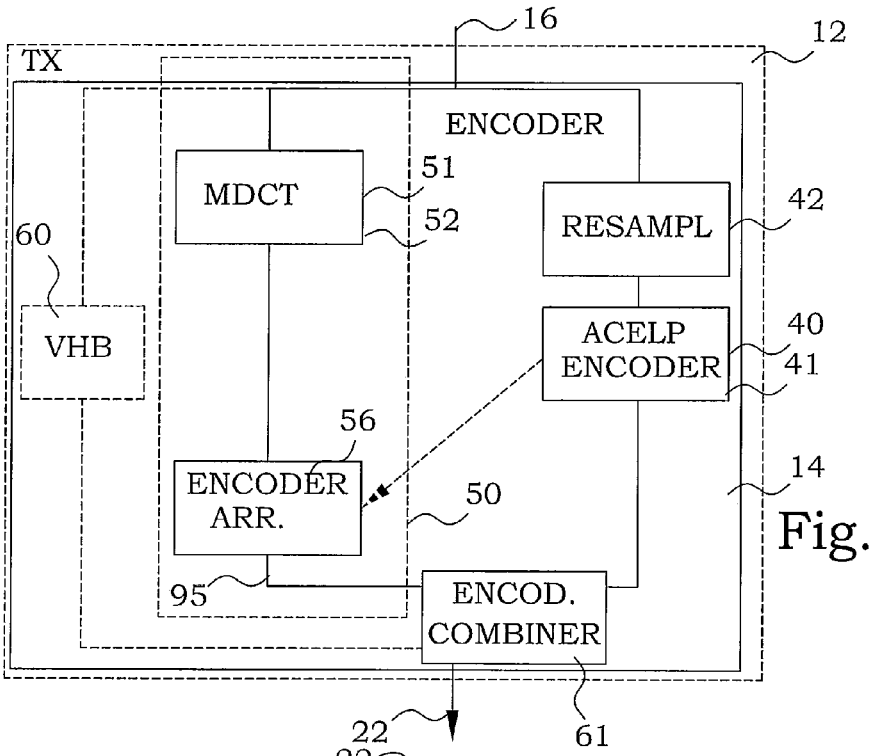
FIG. 2B is a schematic block diagram of another embodiment of an audio encoder.

FIG. 2B illustrates another embodiment of an audio encoder 14. Here the core encoder 40 is an ACELP encoder 41, i.e. an example of a CELP encoder. In alternative embodiments, other types of CELP encoders could also be utilized. The operation of CELP or ACELP as such, is well known within the art of codecs, and will not be discussed more in detail. The ACELP encoder 41 of the present embodiment operates on a resampled version of the audio signal 16. A resampling unit 42 is therefore provided between the input of the audio sample and the ACELP encoder 41. The ACELP encoder 41 thereby provides an encoding of a low band of the audio signal 16. The ACELP codec can achieve high-quality encoding at up to 8-12 kbit/s.

The ACELP encoding is complemented by a low-bitrate BWE for high bands. The transform encoder 52 is in this particular embodiment a Modified Discrete Cosine Transform (MDCT) encoder 52. However, in alternative embodiments, the transform encoder 52 could also be based on other transforms. Non-exclusive examples of such transforms are Fourier Transforms, different types of Sine or Cosine Transforms, Karhunen-Loeve-transform, or different types of filterbanks. The operation, as such, of such transforms, is well known within the art of codecs, and will not be discussed more in detail. The encoder arrangement 56 is arranged for providing BWE information concerning at least a high band. The high band, as the name suggests, is situated at higher frequencies than the ACELP encoded low band. In the present embodiment, an encoder combiner 61 is connected to the ACELP encoder 41 and the encoder apparatus 50 based on the MDCT transform and is arranged for providing a suitable joint encoding of all the information about the audio signal. Such representation of the audio signal is provided as a binary flux 22.

In a particular embodiment, the input and output signals are sampled at 32 kHz, which gives the basis for the MDCT BWE. The signal for the ACELP core encoding is resampled to 12.8 kHz.

Figure 3A:
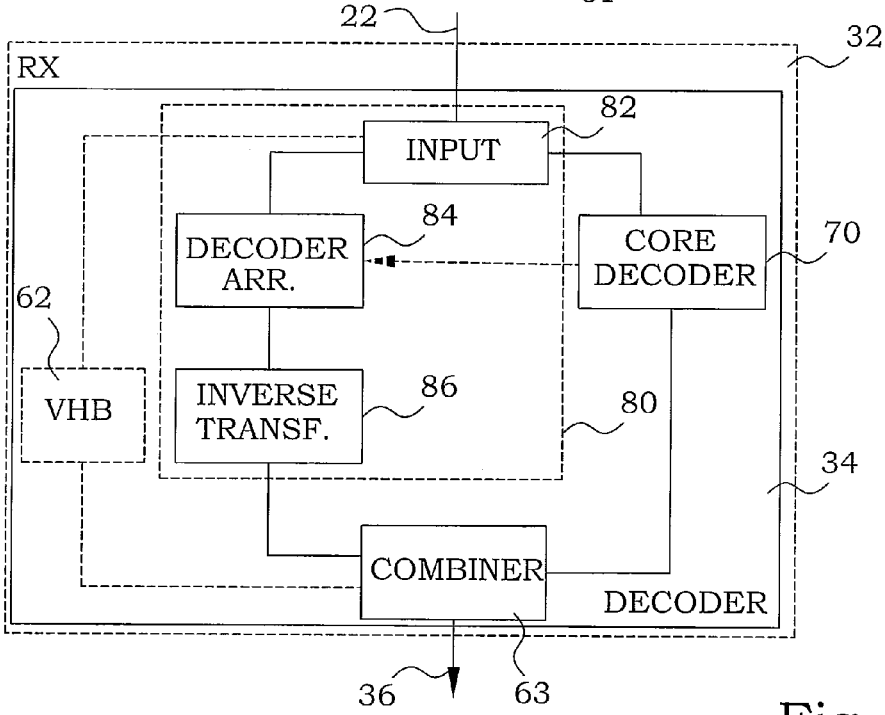
FIG. 3A is a schematic block diagram of an embodiment of an audio decoder.

FIG. 3A illustrates an embodiment of an audio decoder 34 in a receiver 32. A binary flux 22, i.e. encoded information about an audio signal is received in an input block 82. Encoded parameters of a core encoding of the audio signal are provided to a core decoder 70. In the core decoder 70, the parameters are utilized for reconstructing at least a part of an audio signal. Encoded BWE parameters concerning a high band are provided to a decoder arrangement 84. In the decoder arrangement 84, quantization indices are reconstructed from the encoded parameters, and in an inverse transform decoder 86, another part of the audio signal is provided from the quantization indices. The decoder arrangement 84, the inverse transform decoder 86 and at least a part of the input block 82 is comprised in a decoder apparatus 80 handling a high band part of the audio signal. The parts of the audio signal from the core decoder and the decoder apparatus 80 are combined in a combiner 63 into a final decoded audio signal 36. Also here, additional procedures for other bands can be provided, e.g. as exemplified by a very high bandwidth extension decoder 62 in the figure.

Figure 3B:
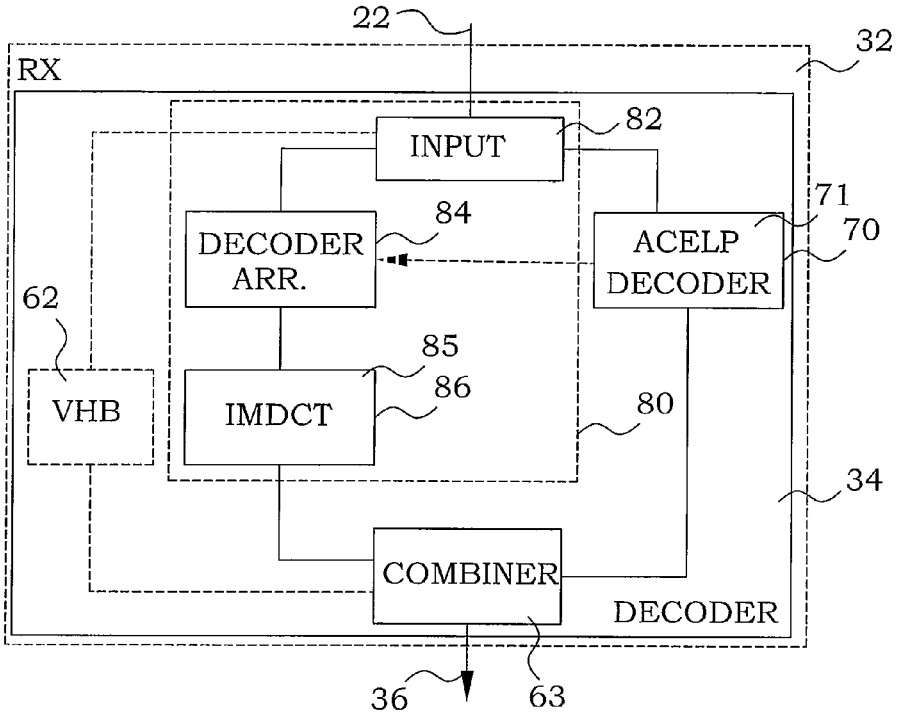
FIG. 3B is a schematic block diagram of another embodiment of an audio decoder.

FIG. 3B illustrates another embodiment of an audio decoder 34. Here the core decoder 70 is an ACELP decoder 71, e.g. an example of a CELP decoder. In alternative embodiments, other types of CELP decoders could also be utilized. The ACELP decoder 71 of the present embodiment operates to provide a part of the audio signal 36 with a low sampling rate. The ACELP decoder 71 thereby provides a decoding of a low band of the audio signal 36. As mentioned above, the ACELP codec can achieve high-quality decoding at up to 8-12 kbit/s.

The ACELP decoding is in analogy with the encoding side complemented by a low-bitrate BWE for high bands. The inverse transform decoder 86 is in this particular embodiment an Inverse Modified Discrete Cosine Transform (IMDCT) decoder 85. However, in alternative embodiments, the transform decoder 86 could also be based on other transforms. Non-exclusive examples of such transforms are Fourier Transforms, different types of Sine or Cosine Transforms, Karhunen-Loeve-transform, or different types of filterbanks.

Figure 4A:
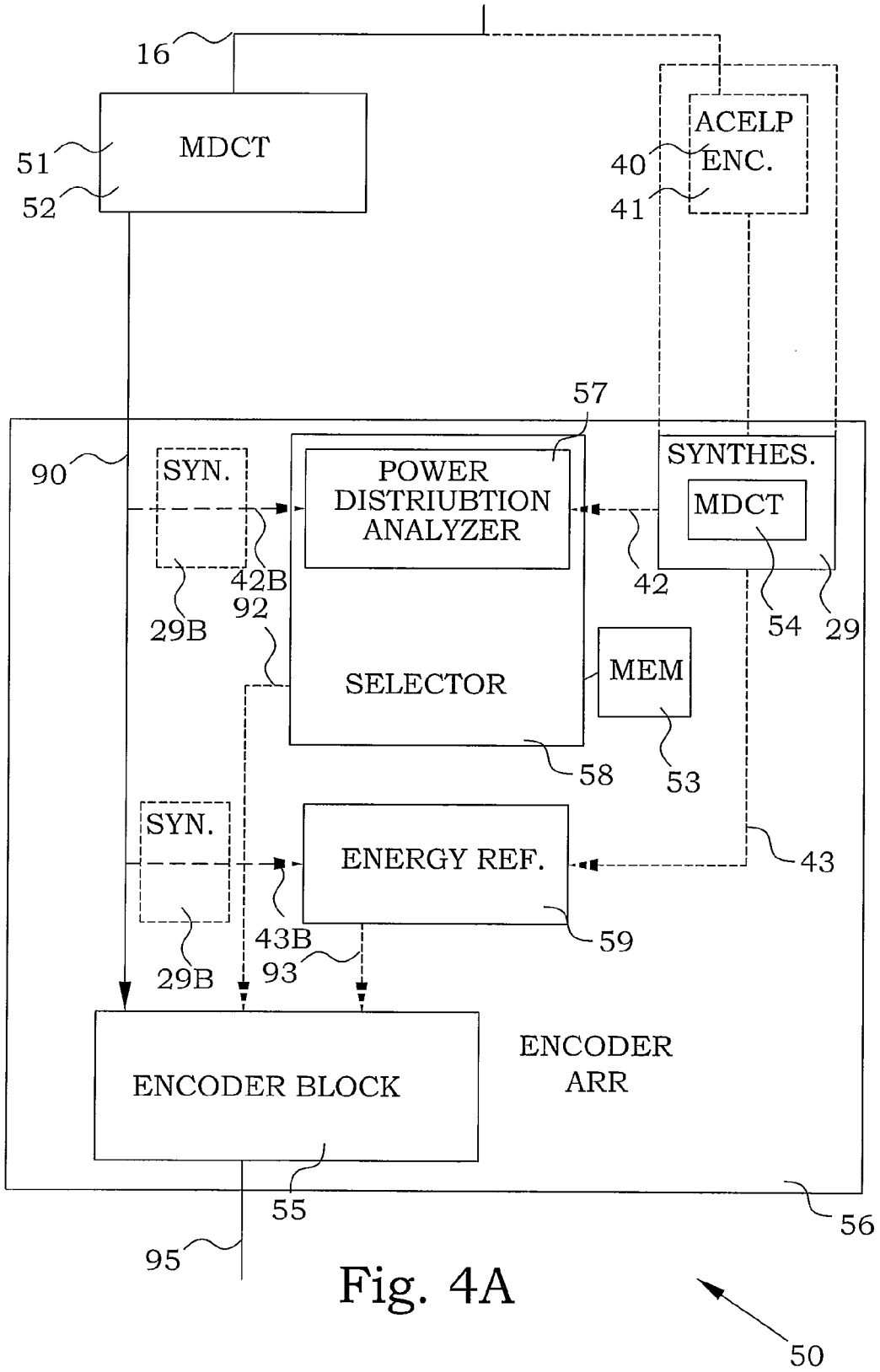
FIG. 4A is a schematic block diagram of an embodiment of an encoder apparatus.

An important part of the present approach is the encoder apparatus handling the BWE. FIG. 4A illustrates an example of an encoder apparatus somewhat more in detail. Some parts have already been discussed above. The transform encoder 52, in this embodiment a MDCT encoder 51, is configured for performing a transform of the audio signal 16 into the transform domain. Such a transform domain version 90 of the audio signal is provided to an encoder block 55 of the encoder arrangement 56. The encoder block 55 is connected to the transform encoder 52 and is configured for quantizing a spectrum envelope of the transform encoding. The encoder block 55 is further configured for determining a respective scalar quantization of the spectrum envelope in a plurality of subbands in the transform domain of the audio signal. These subbands together constitute at least a high band of the audio signal.

The encoder arrangement 56 comprises a selector 58, in this embodiment comprising a power distribution analyzer 57. This power distribution analyzer 57 is configured for obtaining a power distribution of the audio signal in the transform domain. As will be discussed further below, different types of audio signals can have very differing behavior in the transform domain. Such behaviors may, however, be utilized for encoding purposes. In one embodiment of a power distribution analyzer 57 a classification of the audio signal into two or more classes is performed. Such a power distribution analyzer 57 can in different embodiments receive spectral information 42 from a synthesizer 29. The synthesizer 29 obtains a low band synthesis signal of an encoding of the audio signal. The synthesis signal may be based on signals of external sources, e.g. from the core encoder 40 via an MDCT transformer 54. The synthesizer 29 may comprise only the MDCT transformer 54 or both the MDCT transformer 54 and an encoder. The spectral information can alternatively be derived directly 42B by a synthesizer 29 directly based on properties of the audio signal in the transform domain. Examples of such analysis or classification will be further discussed below. The selector 58 is configured for providing an energy offset intended for finding suitable quantization indices. The provision of the energy offset is performed by selecting an energy offset 92 from a set of predetermined energy offsets. The set of predetermined energy offsets comprises at least two predetermined energy offsets. This set of predetermined energy offsets is known by both the encoder and decoder and is typically provided in a memory 53, connected to the selector 58. A predetermined energy offset 92 is selected for each of the subbands that are going to be encoded. The selection is furthermore based on the analysis of the audio signal.

In a particular embodiment, the selecting is based on an open loop approach. In this embodiment, a parameter is determined characterizing a power distribution of the audio signal in the transform domain. The actual selection is then performed based on the determined parameter. This means that for one type of signal, one energy offset 92 is used for encoding each individual subband.

The encoder arrangement 56 further comprises an energy reference block 59. The energy reference block is configured for obtaining an energy measure 93 to be used as an energy reference. The energy measure 93 is an energy measure of a first reference band within a low band in the transform domain of the audio signal. A low band signal 43 with the first reference band can be obtained e.g. from the core encoder 40, via the MDCT transformer 54. Alternatively, a low band signal 43B could be achieved from the transform domain version 90 of the audio signal. The energy measure is typically a mean energy of the first reference band. In alternative embodiments, the energy measure could instead be any other characteristic statistical measure of the energies of the first reference band, such as e.g. median value, a mean square value or a weighted average value. This reference energy measure is used as a starting point of a relative quantization of the MDCT envelope. The band in which the first reference band is selected is situated at lower frequencies than the band that the encoder apparatus 50 is supposed to handle. In other words, the high band is situated at higher frequencies than the low band of the audio signal, just as the notation indicates.

An encoder block 55 is connected to the selector 58, the transform encoder 52 and the energy reference block 59 for receiving the selection of the energy offset range 92, the transform domain version 90 of the audio signal and the energy measure 93. The encoder block 55 is configured for encoding said high band by providing a set of quantization indices representing a respective scalar quantization of a spectrum envelope relative to the energy measure 93 of the first reference band and by use of the selected energy offset 92. The encoder block 55 thereby outputs a set of parameters 95 representing the relative energies. The encoder block 55 is further configured for providing a parameter defining the used predetermined energy offset. These outputs are then in particular embodiments combined with the core encoding and other BWE encodings and transmitted to the receiver.

Figure 4B:
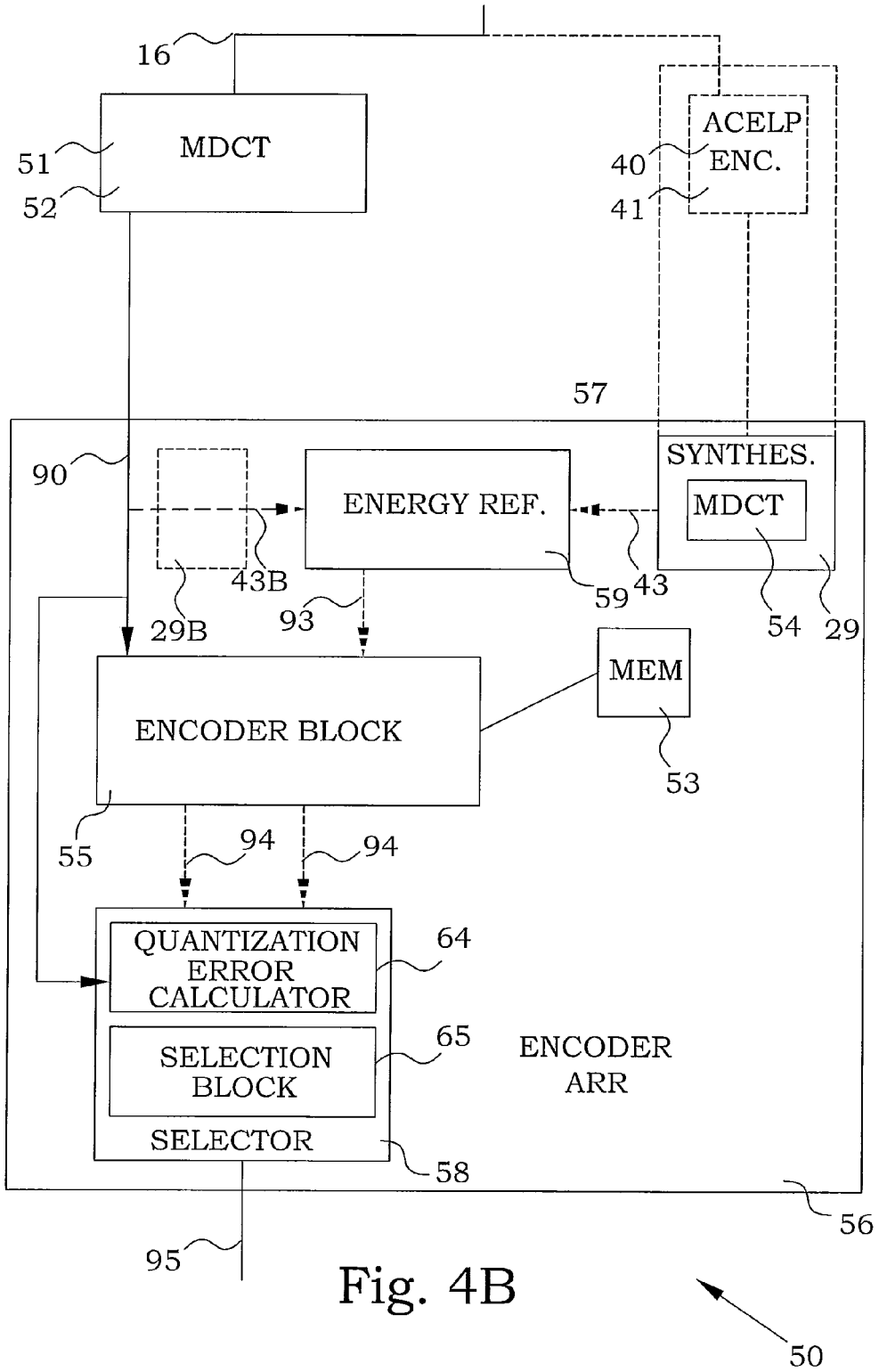
FIG. 4B is a schematic block diagram of another embodiment of an encoder apparatus.

FIG. 4B schematically illustrates another example of an encoder apparatus 50. In this embodiment, the selection of the energy offset to use is performed in a closed-loop approach. This essentially means that all energy offsets are tested and the one with the best result is selected. The encoding strategy is also known as analysis-by-synthesis. To this end, the memory 53 is connected to the encoder block 55. The encoder block 55 is further configured for providing one set of the quantization indices 94 for each available energy offset. In the present embodiment, two predetermined energy offsets are used and therefore the encoder block 55 produces two sets of the quantization indices 94. In other embodiments, more than two predetermined energy offsets are defined and consequently, more than two sets of the quantization indices 94 are produced.

In this embodiment, the selector 58 is configured for receiving the quantization indices for all predetermined energy offsets. The selector 58 here comprises a calculation block 64 and a selection block 65. The calculation block 64 is configured for calculating a quantization error for each of the sets of quantization indices. To this end, the calculation block also has access to the original transformed audio signal 90. The selection block 65 is then configured for selecting the set of quantization indices giving the smallest quantization error. These quantization indices are used as the output set of parameters 95 together with the parameter defining the used energy offset.

Figure 5:
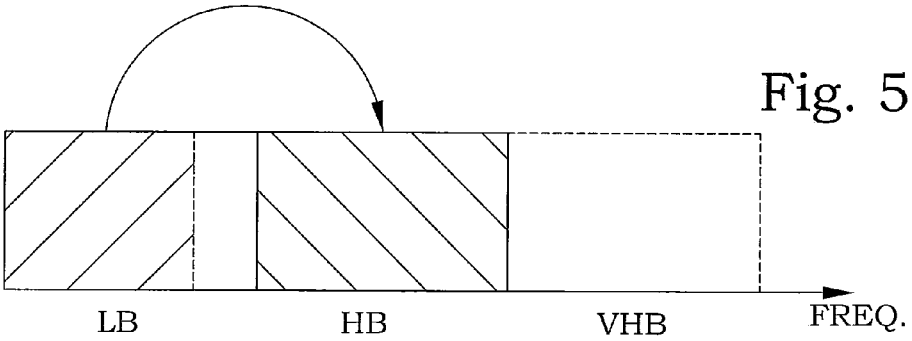
FIG. 5 is a diagram illustrating an energy reference relation in a bandwidth extension.

FIG. 5 illustrates the relation between the reference energy and the different bands. A low band LB is encoded by a core encoding method. At least a part of the low band LB, the first reference band, is then utilized for determining an energy level that is going to be used as a reference for the energy offset encoding of a high band HB. The first reference band may comprises the entire low band, or as illustrated a part of the low band.

The frequency ranges for the low band and high band can be selected depending on the total available bit rate, the used encoding techniques, the required level of audio quality etc. In a particular embodiment, typically intended for wireless communication, the low band ranges from essentially 0 to 6.4 kHz. The first reference band ranges from 0-5.9 kHz, however, in an alternative embodiment the entire low band is comprised in the first reference band. The upper limit of the high band is 11.6 kHz in the present embodiment. The reason to limit envelope quantization to 11.6 kHz is the decreased resolution of human auditory system in these frequencies, and low energy in speech signal. Optionally, a very high band VHB above the high band upper limit can be encoded by further BWE methods, e.g. in that the envelope in the very high band region above 11.6 kHz is predicted. However, such aspects are not within the main scope of the present disclosure. The number of subbands can also be selected in different manners. Numerous subbands give a better prediction but require higher bit-rates. In this particular embodiment, 8 subbands are used. The low band region is ACELP coded, and the high band is reconstructed in MDCT domains.

Figure 6A:
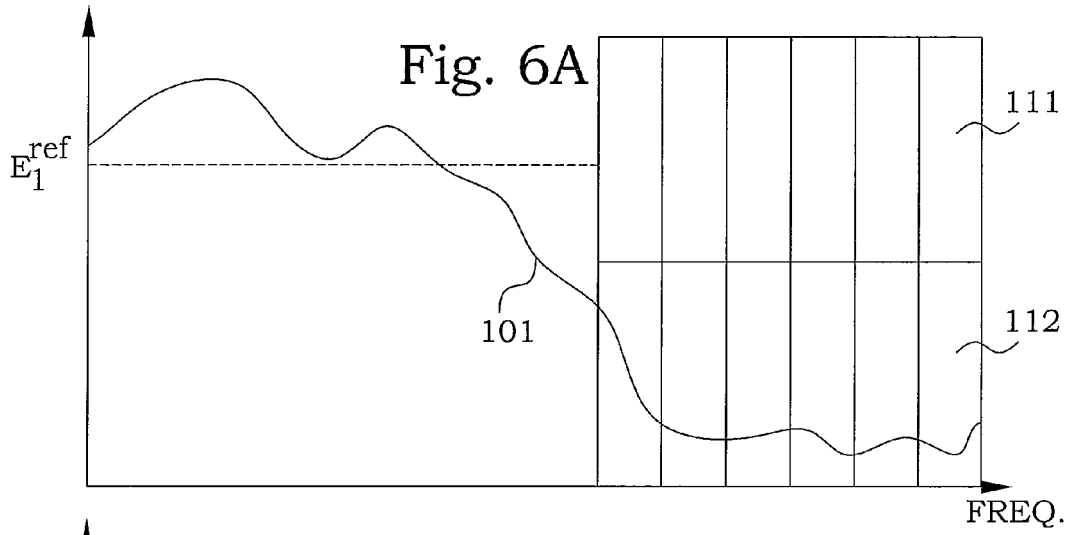
FIGS. 6A-C are diagrams illustrating audio signals of different classes.
Figure 6B:
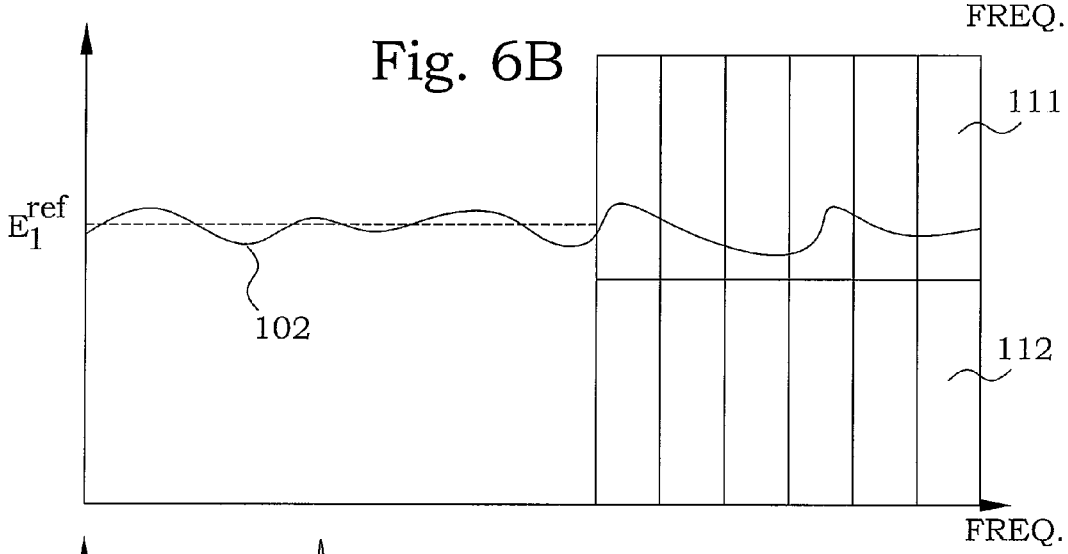
Figure 6C:
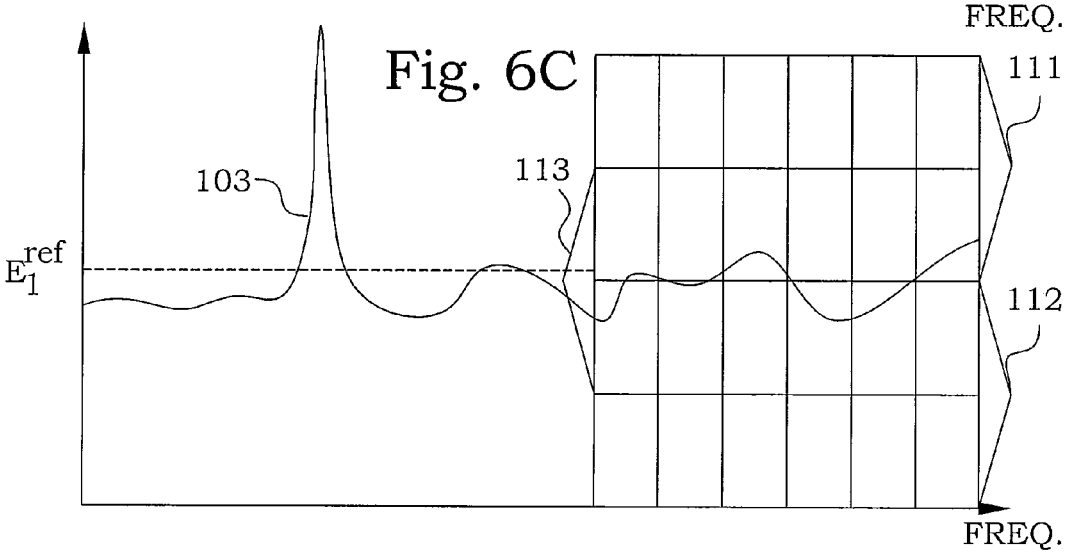

Audio signals may look very different depending on the type of sound it represents. Voice activity detection may e.g. be used for switching to alternative encoding schemes. FIGS. 6A-C illustrate three different kinds of audio signals. The actual curves are fictive, but reveal the same general trends as may be found in real samples. In FIG. 6A, an example of an audio signal 101 is illustrated. The energies are generally higher at low frequencies compared to the high frequencies. An average energy level of a low frequency region is determined as a reference $E_1^{ref}$ and is illustrated by the broken line. When encoding the envelope of the subbands of the high band part, it can be seen that all energies fall far below the reference level. To encode the energy offset relative to the reference $E_1^{ref}$, only the lower part of the energy scale is needed. This means that a set of energy offsets used for encoding the energies in the high band part can be restricted to the lower part 112 of the energy scale.

In FIG. 6B, another audio signal is illustrated. Here, the energy level is more or less equal over the entire frequency range, which means that the energy reference $E_1^{ref}$ is close to the curve also in the high frequency band. The lower part 112 of the energy scale is now unsuitable for the energy offset encoding. Instead the upper part 111 can be used.

Figure 7A:
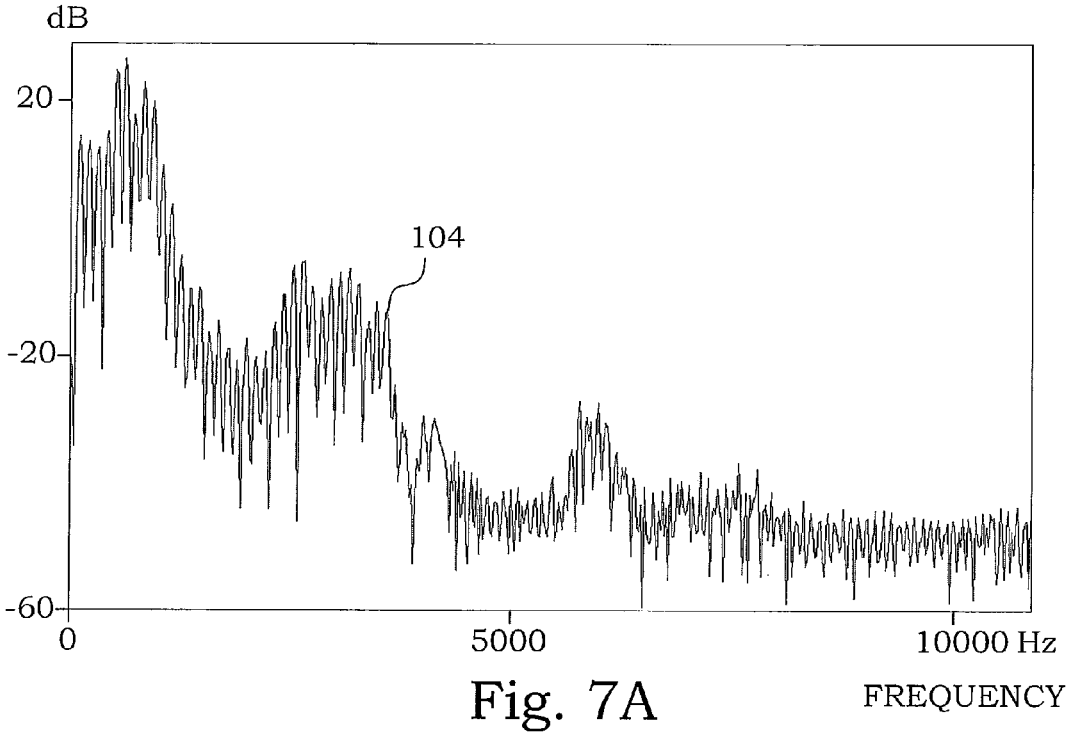
FIGS. 7A-B are diagrams illustrating voiced and unvoiced audio signals, respectively.
Figure 7B:
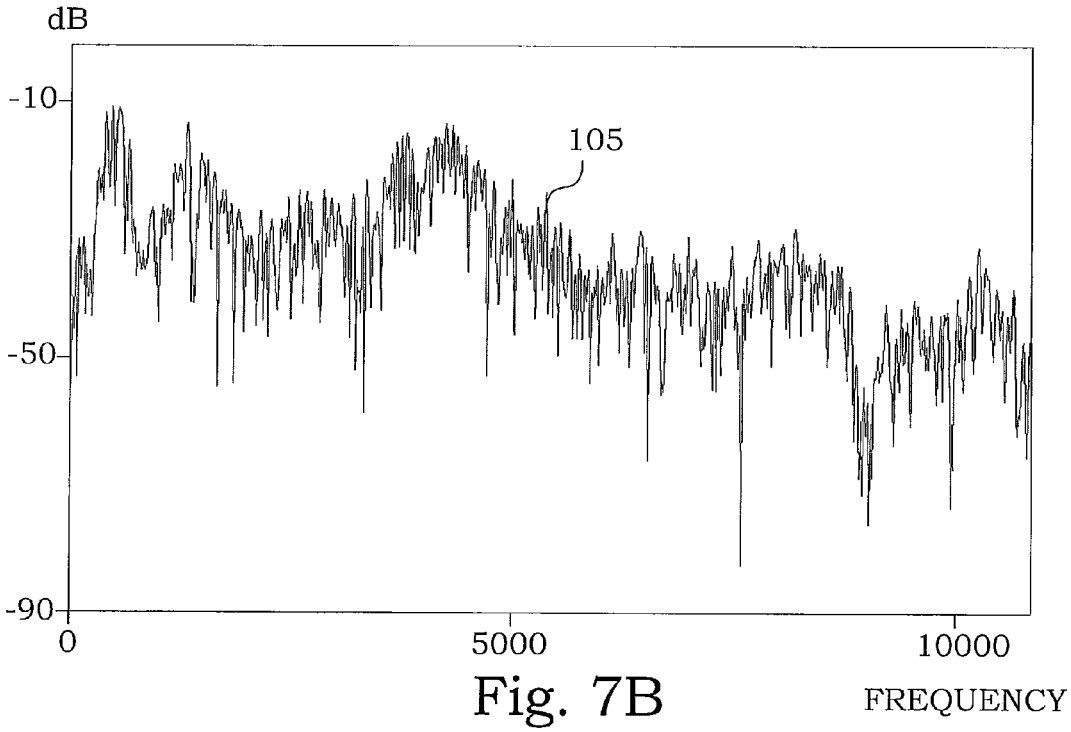

Real examples of voiced and unvoiced speech are presented in the FIGS. 7A and 7B, where the curve 104 is representative of voiced speech segments and curve 105 is representative of un-voiced speech segments. In voiced speech segments, the energy in the range 6.4-11.6 kHz is more than 40 dB below the low-band energy in the range below 6.4 kHz. In unvoiced speech segments, low- and high-band energies are at approximately the same level.

By making use of an analysis of the power distribution between different bands of the audio signal, a suitable energy offset can be selected, that is narrower than for general audio signals. By determining a parameter that characterizes important aspects of a power distribution of the audio signal in the frequency domain, such a parameter can be utilized for making a selection of a useful energy offset. If the energy offset used for each case by such actions is reduced to half compared to the total energy offset range, one bit can be saved in the encoding of each subband. If, as in the embodiments of FIGS. 6A and B, six subbands are used, six bits can be saved for each audio sample. Since the selection of the used predetermined energy offset also has to be transmitted, the total gain becomes in such a case 5 bits.

The concept of selecting a proper energy offset depending on an analysis of the power distribution of the audio signal can be further generalized. In FIG. 6C, a signal having an exceptional high energy for a particular frequency is shown. Such signal will have a reference $E_1^{ref}$ that is higher than for normal audio, which results in that none of the ranges 111, 112 associated with the energy offsets is suitable for the encoding. A particular energy range 113 associated with a particular energy offset can instead be defined. This principle can be further applied e.g. on transient signals etc. The energy offsets to select between are determined beforehand, so that this information is shared between the transmitting and receiving sides. Also the criteria for the analysis and the analysis itself are predetermined.

In the open loop approach of the embodiment of FIG. 4B, the power distribution is indirectly analyzed. The energy offset between different bands of the audio signal is of importance for the quantization. A proper choice of energy offset will give small quantization errors, which means that an energy distribution of the audio signal in the different bands agrees with the selected range.

Figure 8A:
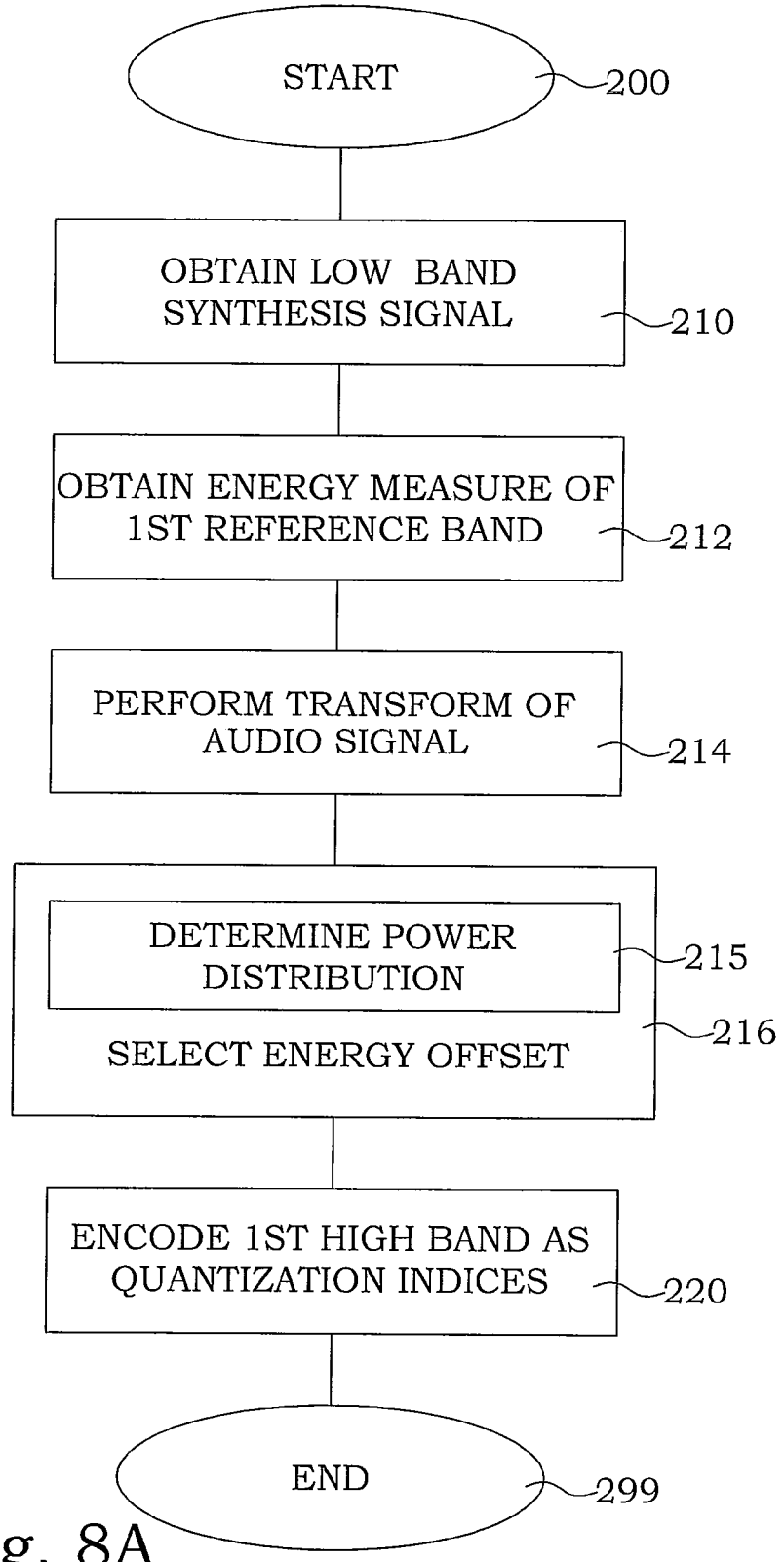
FIG. 8A is a flow diagram of steps of an embodiment of an encoding method.

FIG. 8A illustrates a flow diagram of steps of an example of a method for encoding of an audio signal with an apparatus according to the previous ideas. The procedure starts in step 200. In step 210, a low band synthesis signal of an encoding of the audio signal is obtained. A first energy measure of a first reference band within a low band in said low band synthesis signal is obtained in step 212. In step 214, a transform of the audio signal into a transform domain is performed. An energy offset is in step 216 selected from a set of predetermined energy offsets for each of a plurality of subbands of a first high band in the transform domain. The first high band is situated at higher frequencies than the low band of the audio signal. In step 220, the first high band of the audio signal is encoded. A set of quantization indices are provided, representing a respective scalar quantization of a spectrum envelope in the plurality of first subbands of the first high band relative to the energy measure of the first reference band. The quantization indices are given with a respective selected energy offset. The step of encoding of the first high band further comprises providing of a parameter defining the used energy offset. The procedure ends in step 299.

In this particular embodiment, the step of selecting 216 an energy offset is dependent on a power distribution of the audio signal in a frequency domain. To this end, the step of selecting 216 a predetermined energy offset range is based on an open loop procedure, comprising the step 215 of determining a parameter characterizing a power distribution of said audio signal in a frequency domain. The actual selecting is then based on the determined parameter.

In one particular embodiment, the transform encoding is a Modified Discrete Cosine Transform. Also in one particular embodiment, the classification comprises classification between a class of voiced audio signals and a class of unvoiced audio signals. Furthermore, in one particular embodiment, the low band is encoded by a CELP encoder.

Figure 8B:
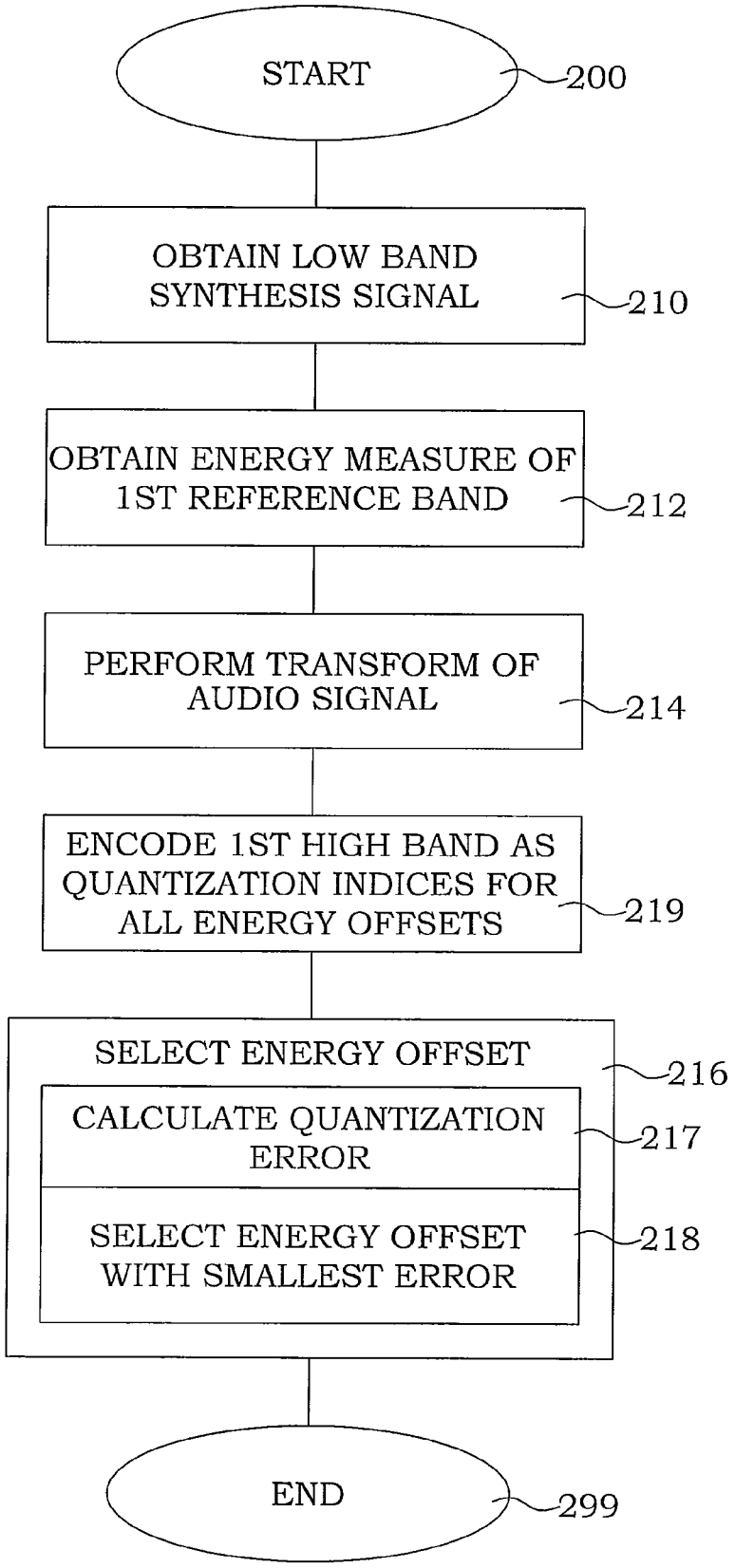
FIG. 8B is a flow diagram of steps of another embodiment of an encoding method.

FIG. 8B illustrates a flow diagram of steps of another example of a method for encoding of an audio signal. Most steps are similar to the ones presented in FIG. 8A, and are not further discussed. In this example, a step 219 of encoding the first high band in turn comprises providing of one set of the quantization indices for each available predetermined energy offset. In step 216, in this example occurring after the step 219, the energy offset to be used is selected. In this example, this is performed by, as indicated in step 217, calculating a quantization error for each of the sets of quantization indices. In step 218, the set of the quantization indices giving the smallest quantization error is selected.

Figure 9:
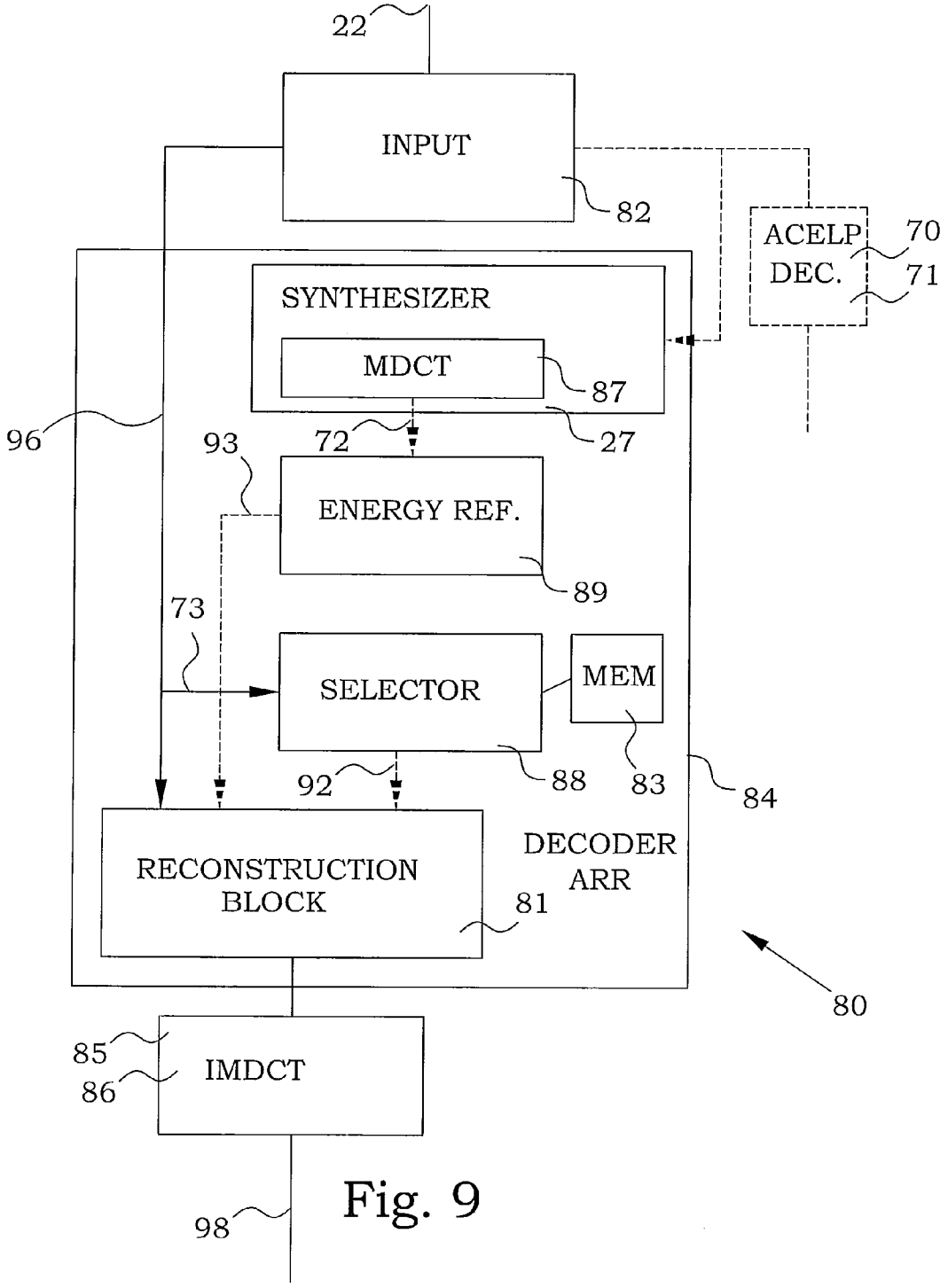
FIG. 9 is a schematic block diagram of an embodiment of a decoder apparatus.

FIG. 9 illustrates a block diagram of an example of a decoder apparatus 80. As in FIG. 3B, the decoder apparatus 80 comprises an input block 82 and an inverse transform decoder 85. The input block 82 is configured for receiving an encoding of at least a high band of the audio signal. The encoding represents a set of quantization indices 96 of a spectrum envelope in a plurality of first subbands of the high band of the audio signal. The quantization indices 96 represent energies relative to an energy measure. The encoding also comprises a parameter defining a used predetermined energy offset. A decoder arrangement 84 comprises an energy reference block 89, an MDCT transform encoder 87, a synthesizer 27, a selector 88, a memory 83 and a reconstruction block 81.

The synthesizer 27 is configured for obtaining a low band synthesis signal of an encoding of the audio signal. The synthesis signal may be based on signals of external sources, e.g. from the signal provided to a core decoder 70 via an MDCT transformer 87.

The energy reference block 89 is configured for receiving the energy measure 72 of the first reference band within the low band in a transform domain of the audio signal. The energy measure, i.e. the energy reference 93 is provided to the reconstruction block 81.

The parameter defining a used energy offset is provided to the selector 88. The selector 88 is configured for selecting an energy offset from a set of predetermined energy offsets for each of the first subbands based on the parameter. The reconstruction block 81 is connected to the input block 82, the selector 88 and the energy reference block 89. The reconstruction block 81 is configured for reconstructing a signal in a transform domain by determining a spectrum envelope in the high band from the set of quantization indices 96 by use of the selected of energy offset 92 and the energy measure 93 of the reference band.

The inverse transform decoder 85 is connected to the reconstruction block 81 and configured for performing an inverse transform based on at least the reconstructed energy offsets into at least a part 98 the audio signal.

Figure 10:
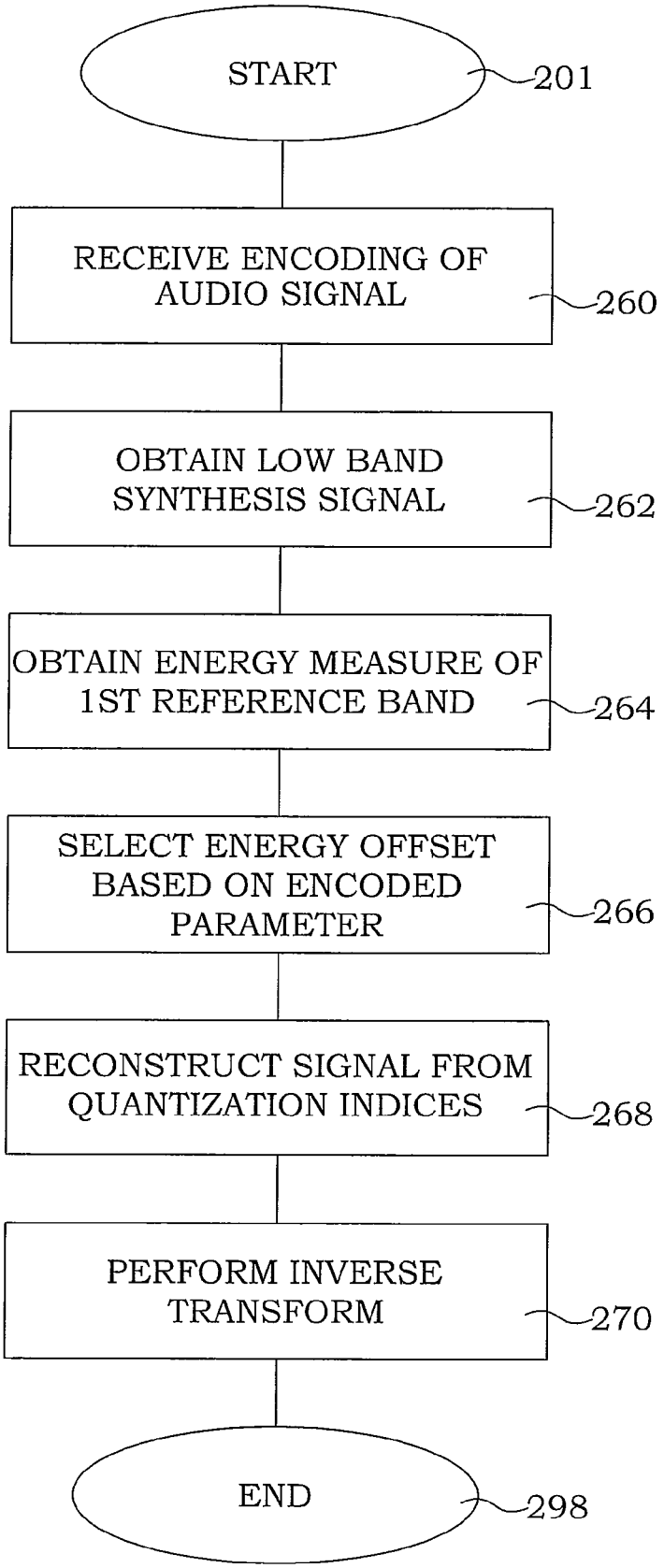
FIG. 10 is a flow diagram of steps of an embodiment of a decoding method.

FIG. 10 illustrates a flow diagram of steps of an example of a method for decoding of an audio signal. The process starts in step 201. In step 260, an encoding of a high band of the audio signal is received. The encoding represents a set of quantization indices of a spectrum envelope in a plurality of first subbands of the high band of the audio signal. The first set of quantization indices represents energies relative to an energy measure. In step 262, a low band synthesis signal of an encoding of the audio signal is obtained. The energy measure is obtained in step 264 as an energy measure of a first reference band within the low band of the audio signal is received.

The encoding further represents a parameter defining a used energy offset range. An energy offset is in step 266 selected from a set of at least two predetermined energy offsets. This is performed for each of the first subbands and is based on the parameter defining a used energy offset. A signal in a transform domain is in step 268 reconstructed by determining a spectrum envelope in the high band from the set of quantization indices corresponding to the first subbands by use of the selected energy offset and the energy measure of the first reference band for each of said first subbands of said first high band. In step 270, an inverse transform is performed based on at least the reconstructed signal in said transform domain into at least a part of the audio signal.

In one particular embodiment, the transform encoding is a Modified Discrete Cosine Transform. Also in one particular embodiment, the classification comprises classification between a class of voiced audio signals and a class of unvoiced audio signals. Furthermore, in one particular embodiment, the low band is encoded by a CELP encoder.

Figure 11:
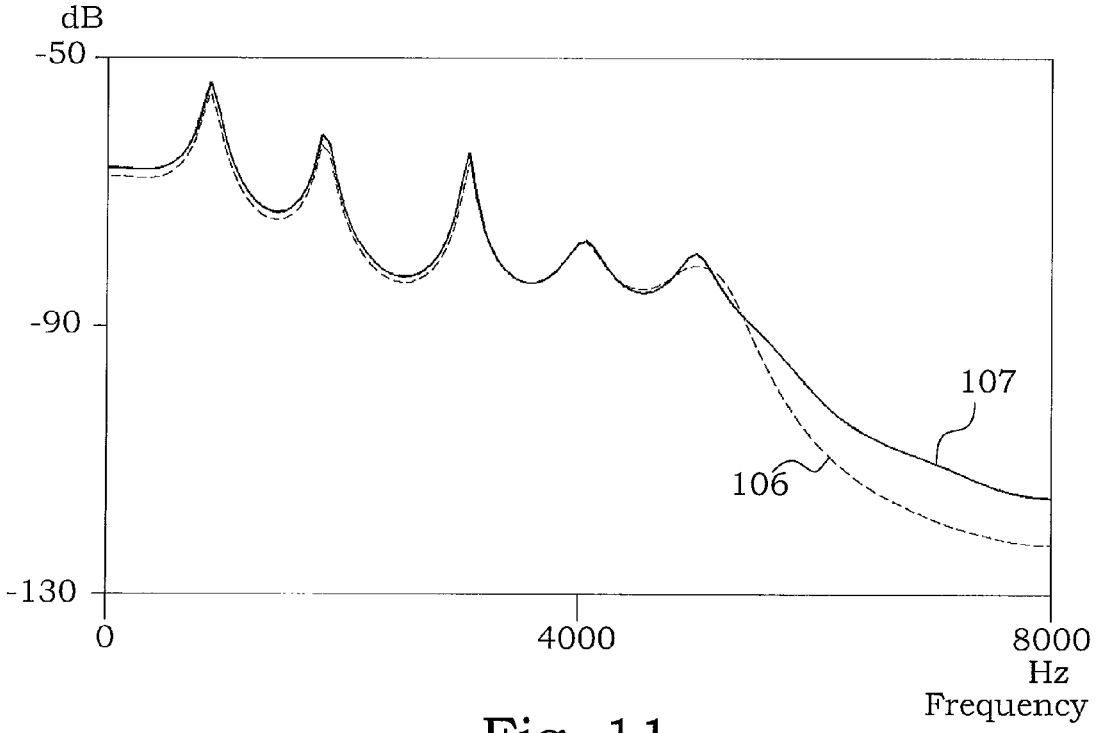
FIG. 11 is a diagram illustrating an example of a difference between an original spectrum envelope and an output from an ACELP encoding.

FIG. 11 illustrates autoregressive spectrum envelopes for both an original signal, and an ACELP output coded up to 6.4 kHz. The coded signal typically compensates for the energy loss, starting slightly below 6 kHz, but this compensation is only partial. This gives implications for the present invention. In other words, the low band is in particular embodiments processed by a method giving energy attenuation at the high frequency end of the low band. Such energy attenuation may, when the low band is used together with conventional BWE, give rise to a step in energy in the transition from the low band to the high band. This gives sometimes rise to a strange perception of the audio signal. In other words, using different strategies for encoding of the low band and high band may cause problems in the crossover region between the bands. The present invention aims for finding BWE encoding schemes which efficiently uses the information in the lower band and also allows for handling the transition from one coding domain into another.

In particular embodiments, the above possible step in energy is preferably restricted. This is achieved by constraining the encoded energy in the subbands closest to the low band not to differ too much from an energy level in the high end of the low band. This is achieved by providing ranges of encoded energies that are restricted not to support encoding of too large positive energy changes. The encoder is constrained not to allow any rapid energy increase, even if this creates mismatch with the original signal energy in these closest subbands. The reference energy for such an increase constraint is derived from a second reference band within the low band. In a particular embodiment, this second reference band is situated at the high end of the low band. In the example given further above, it could e.g. be suitable to select a band of 5.9-6.4 kHz for establishing this second reference energy.

In other words, the high band is divided into two parts. A first high band, situated at the high frequency end of the high band, is encoded according to the principles described further above. A second high band comprises frequencies between the first high band and the low band. In this second high band, the encoded energies, i.e. the quantization indices are restricted in increased energy direction. In other words, the encoded energies are not allowed to increase too fast as compared to the high frequency end of the low band. This is achieved by providing allowed ranges of quantization indices, which do not allow more than a limited positive energy change. The further away from the low band a subband of the second high band is situated, the less restricted is the used quantization indices. In other words, the energy restriction of the encoded energies is reduced with increasing frequency of the second subbands.

In a particular embodiment, the first high band comprises 5 first subbands and covers the range of 8-11.6 kHz. The second high band comprises 3 subbands and ranges between 6.4 and 8 kHz. The MDCT BWE is realized as high-frequency envelope quantization at 1.55 kbit/s. The signal in band 0-6.4 kHz is fully quantized by the ACELP codec. The second reference band ranges between 5.9 and 6.4 kHz. The energy restriction for the first subband in the second high band is an energy difference from the energy reference of maximum +3 dB. The energy restriction for the second subband in the second high band is an energy difference of maximum +6 dB. The energy restriction for the third subband in the second high band is an energy difference of maximum +9 dB. The scalar quantizers of the different subbands are summarized in Table 1 and Table 2 for the second and first high band, respectively. The "Range 1" corresponds to audio samples having a voiced-type energy distribution, while "Range 2" corresponds to audio samples having an unvoiced-type energy distribution. All scalar quantizers have an offset from the corresponding low-frequency reference energy.

TABLE 1

Description of scalar quantizers for second high band

| Band [kHz] | Bits [bits] | Step [dB] | Range [dB] |
|---|---|---|---|
| 6.4-6.9 | 3 | 6 | [−39, +3] |
| 6.9-7.4 | 4 | 3 | [−39, +6] |
| 7.4-8.0 | 4 | 3 | [−36, +9] |

TABLE 2

Description of scalar quantizers for first high band

| Band [kHz] | Bits [bits] | Step [dB] | Range 1 [dB] | Range 2 [dB] |
|---|---|---|---|---|
| 8.0-8.6 | 4 | 4.4 | [−48, 18] | [−66, 0] |
| 8.6-9.3 | 4 | 4.4 | [−48, 18] | [−66, 0] |
| 9.3-10.0 | 4 | 4.4 | [−48, 18] | [−66, 0] |
| 10.0-10.8 | 3 | 6 | [−24, 18] | [−66, −24] |
| 10.8-11.6 | 3 | 6 | [−24, 18] | [−66, −24] |

Figure 12A:
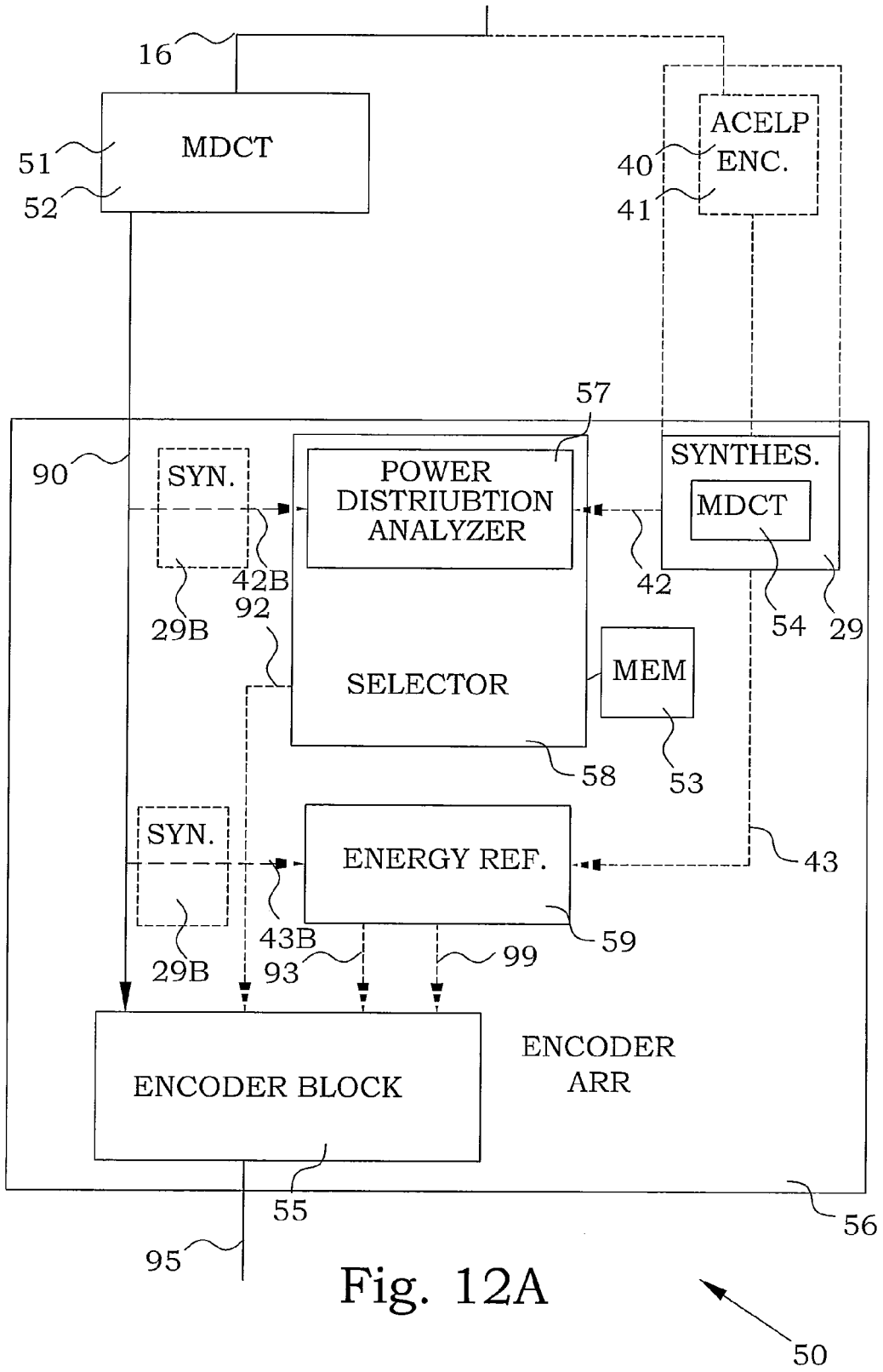
FIG. 12A is a schematic block diagram of another embodiment of an encoder apparatus.

FIG. 12A illustrates an embodiment of an encoder apparatus adapted for the above ideas. The encoder block 55 is, compared to e.g. FIG. 4A, further configured for determining a respective scalar quantization of the spectrum envelope in a plurality of second subbands of a second high band of the audio signal. The energy reference block 59 is further configured for obtaining an energy measure 99 of a second reference band within the low band of the audio signal. The encoder block 55 is further configured for encoding energy offsets of the second high band relative to the energy measure of the second reference band by use of a respective energy offset and quantization index range. The quantization index range is restricted in increased energy direction. As mentioned before, in a particular embodiment, the energy restriction of the quantization indices is reduced with increasing frequency of the second subbands.

Figure 12B:
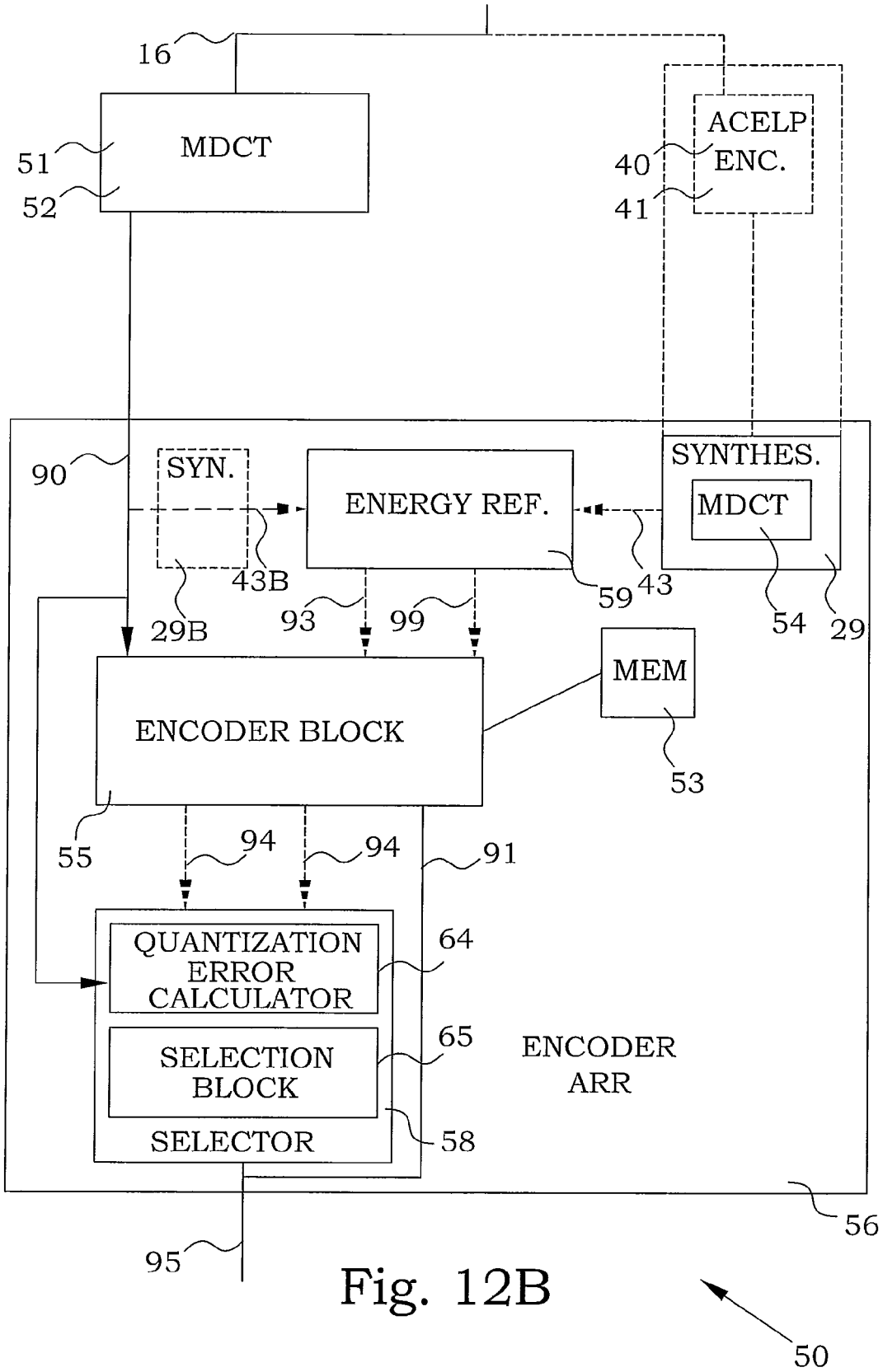
FIG. 12B is a schematic block diagram of yet another embodiment of an encoder apparatus.

FIG. 12B illustrates yet another embodiment of an encoder apparatus adapted for the above ideas. The encoder block 55 and energy reference block are modified compared to e.g. FIG. 4B in the same way as they were made in FIG. 12A.

Figure 13:
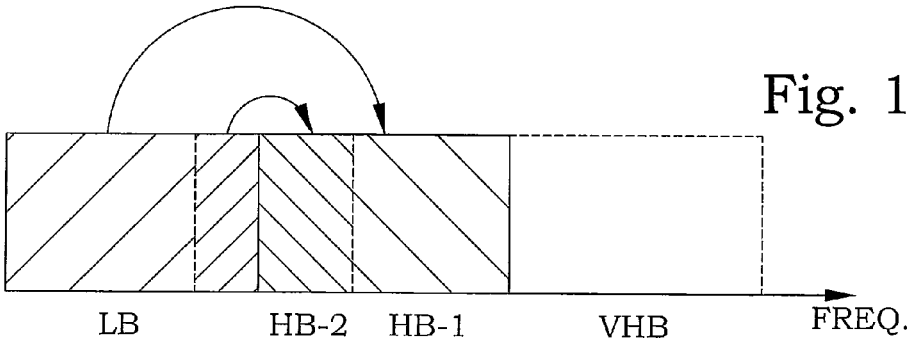
FIG. 13 is a diagram illustrating another energy reference relation in a bandwidth extension.

FIG. 13 illustrates these principles in a frequency diagram. The first high band HB-1 collects its energy reference from a first reference band within the low band LB. This first reference band typically covers at least a large part of the low band. The second high band HB-2 collects its energy reference from a second reference band adjacent to the low frequency end of the second high band. This gives an idea about the energy level in the end of the low band.

Figure 14A:
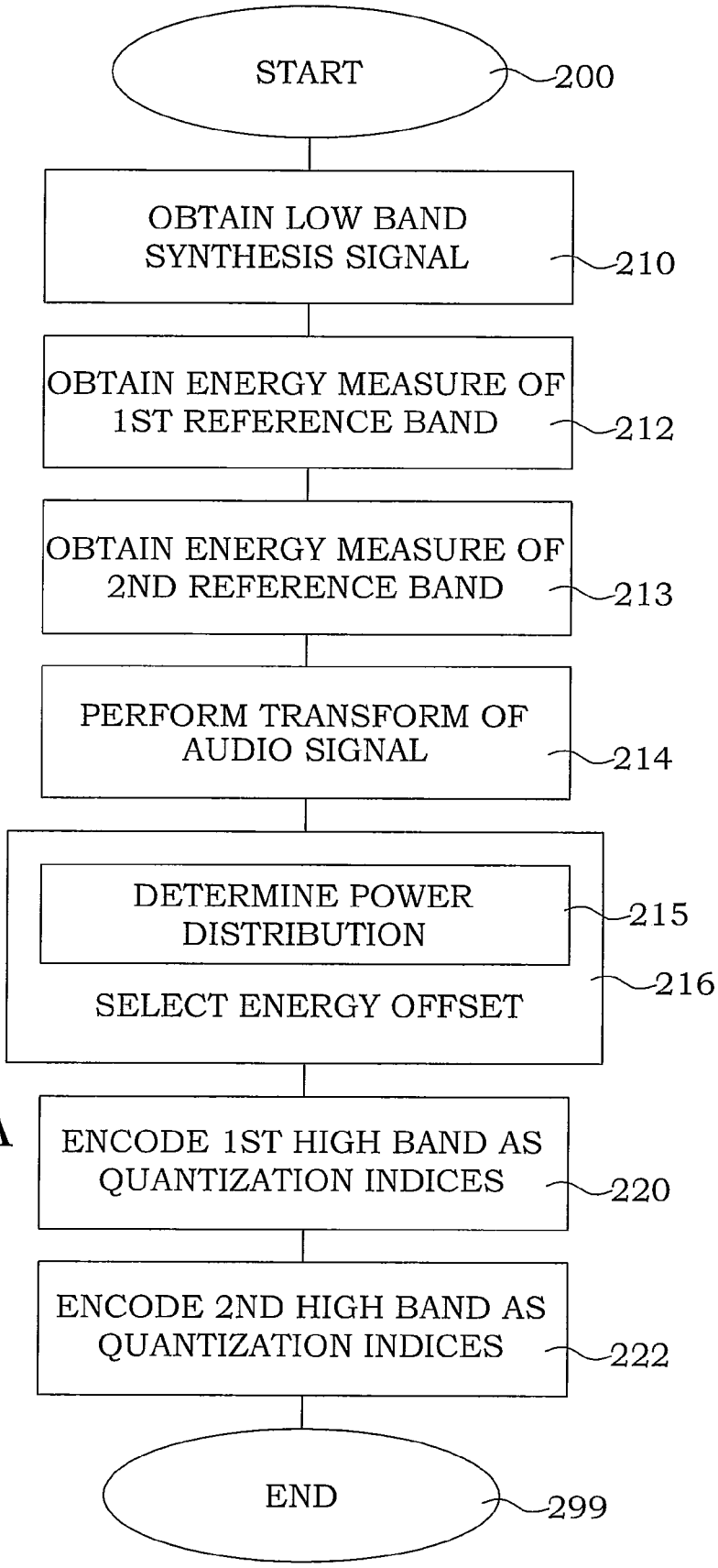
FIG. 14A is a flow diagram of steps of another embodiment of an encoding method.

FIG. 14A illustrates a flow diagram of steps of an embodiment of a method for encoding of an audio signal. Steps that are identical to steps in FIG. 8A are not discussed in detail again. In step 213, an energy measure of a second reference band within the encoding of the low band of the low band synthesis signal is obtained. In step 222, the second high band of the audio signal is encoded. The second high band is situated in frequency between the low band and the first high band. The encoding of the second high band comprises providing of quantization indices representing a respective scalar quantization of a spectrum envelope in a plurality of second subbands of the second high band relative to the energy measure of the second reference band. The quantization indices are preferably restricted in increased energy direction. In the first high band, the encoding according to FIG. 8A is applied.

Figure 14B:
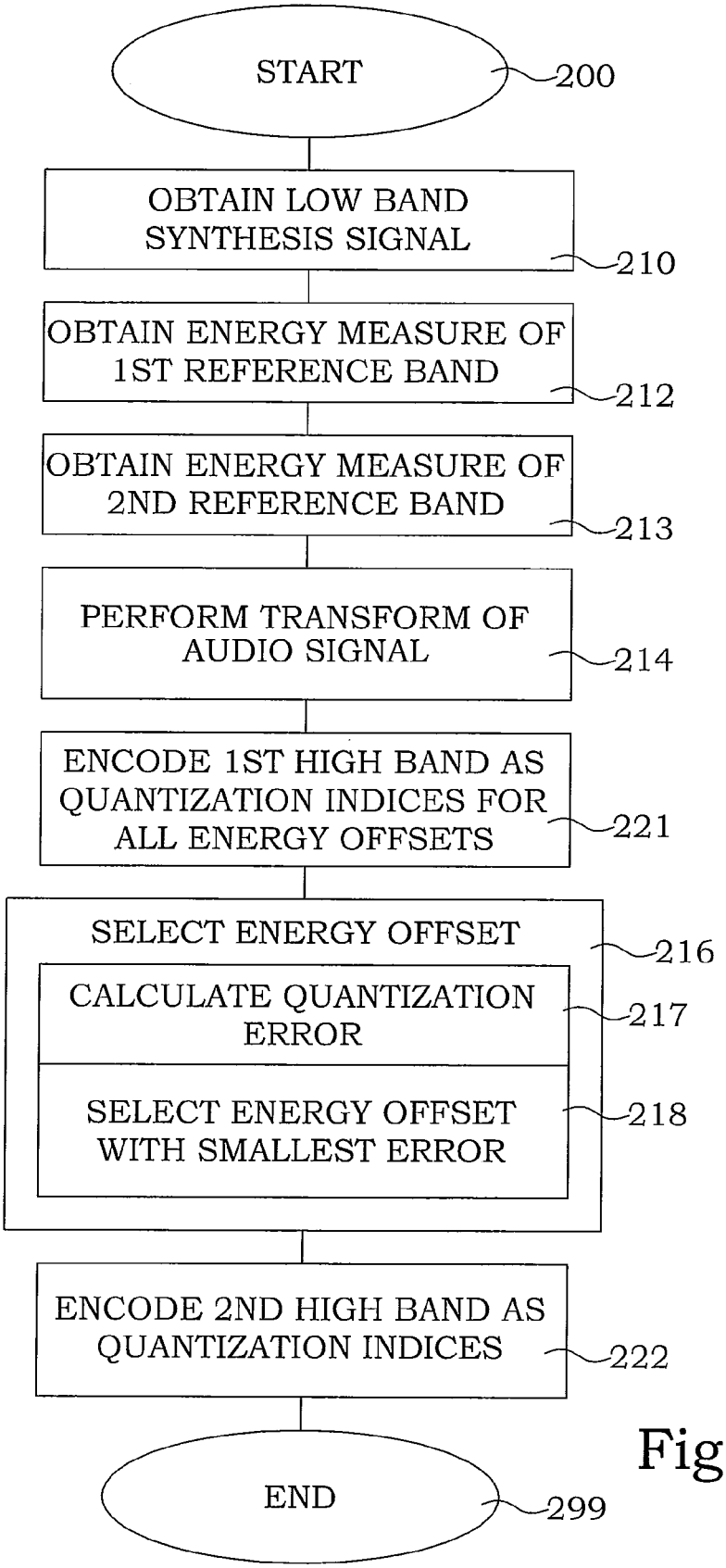
FIG. 14B is a flow diagram of steps of yet another embodiment of an encoding method.

FIG. 14B illustrates a flow diagram of steps of yet another embodiment of a method for encoding of an audio signal. Also here, steps 213 and 222 are added, now compared with the embodiment of FIG. 8B.

Figure 15:
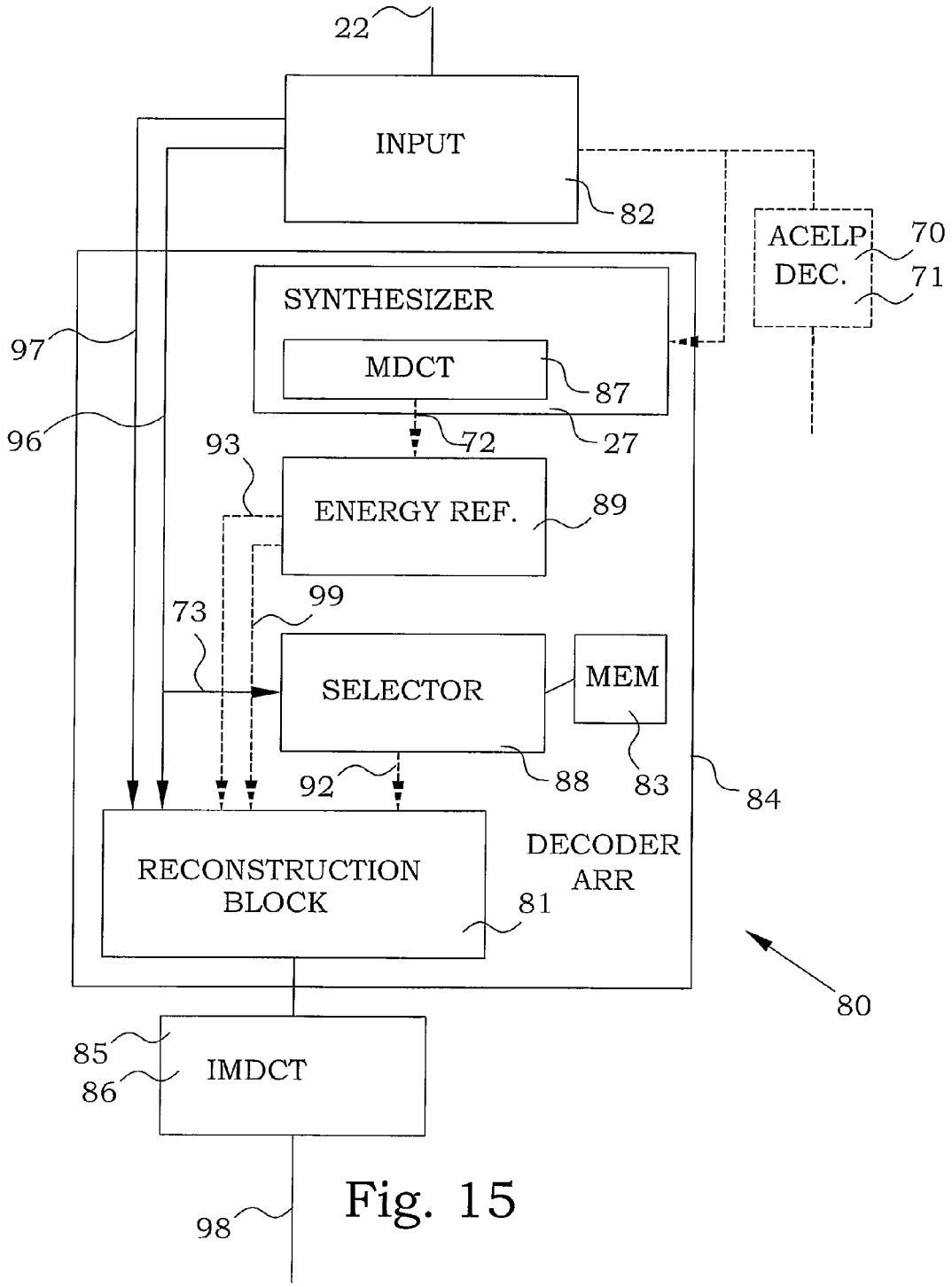
FIG. 15 is a schematic block diagram of another embodiment of a decoder apparatus.

FIG. 15 illustrates an embodiment of a decoder apparatus. Most parts operate in the same way as was described in connection with FIG. 9, and are not described again. In this embodiment, the input block 82 is further configured for receiving an encoding of a second high band of the audio signal. The encoding of the second high band represents quantization indices of a spectrum envelope in a plurality of second subbands of the second high band of the audio signal. The quantization indices represent energies relative to an energy measure of a second reference band within the low band of the low band synthesis signal. The energy reference block 89 is further configured for obtaining the energy measure of the second reference band within the low band of the low band synthesis signal. The reconstruction block 81 is further configured for determining of a spectrum envelope in the second high band from the second set of quantization indices. The transition energies are restricted in increased energy direction. The inverse transform decoder is further configured for performing the inverse transform based also on at least the determined spectrum envelope of the second high band.

Figure 16:
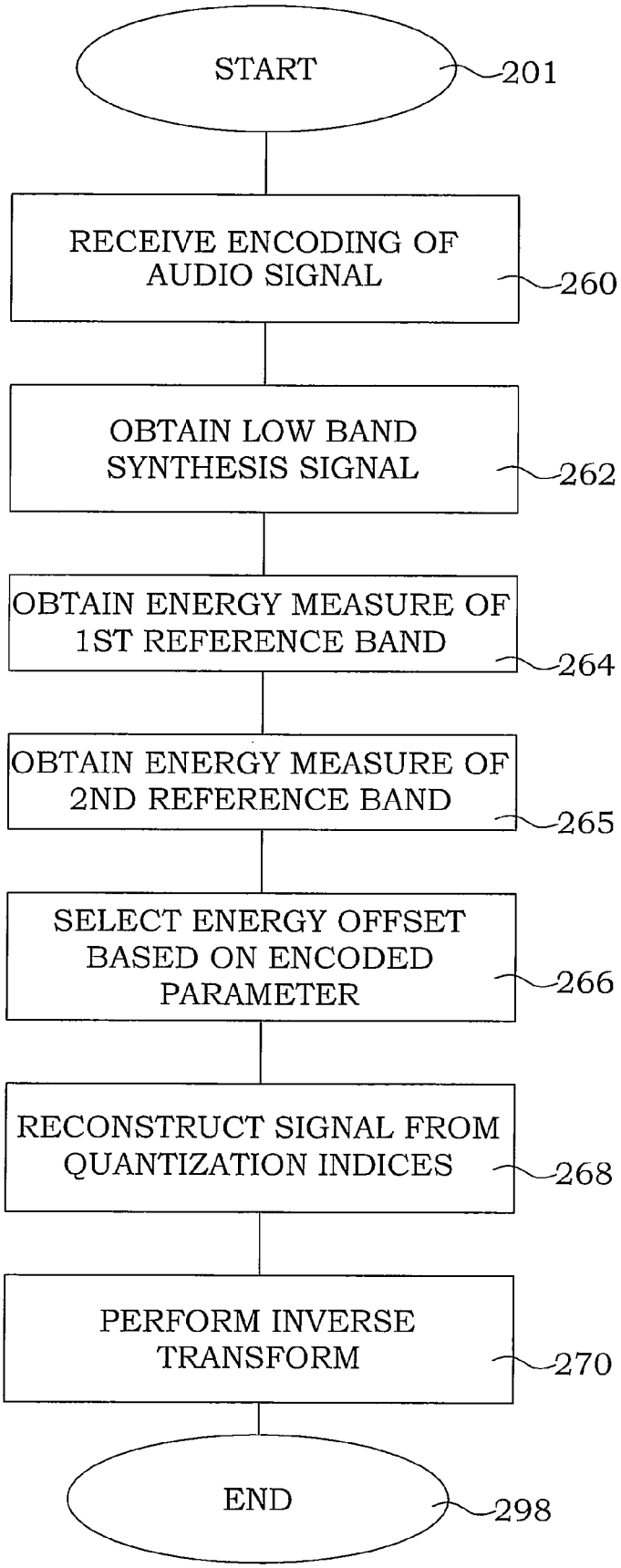
FIG. 16 is a flow diagram of steps of another embodiment of a decoding method.

FIG. 16 illustrates a flow diagram of steps of an embodiment of a method for decoding an audio signal. Similar steps as in FIG. 10 are not discussed again. In step 260, an encoding of both a first and a second high band of the audio signal is received. The encoding of the second high band represents quantization indices of a spectrum envelope in a plurality of second subbands of the second high band of the audio signal. The quantization indices represent energies relative to an energy measure of a second reference band within the low band of the low band synthesis signal. The energy measure of the second reference band within the low band of the low band synthesis signal is received in step 265. Step 268 here further comprises determining of spectrum envelopes from the quantization indices corresponding to the second subbands by use of the energy measure of the second reference band for each of the second subbands of the second high band. The transition energies are restricted in increased energy direction. The step 270 of performing an inverse transform is further based on the determined spectrum envelopes of the second high band.

The different blocks of the encoder and decoder apparatuses are typically implemented in a processing unit, typically a Digital Signal Processor. The processing unit can be a single unit or a plurality of units to perform different steps of procedures described herein. The processing unit may also be the same processing unit that e.g. performs the low band encoding. The "receiving" of data from e.g. the core encoder may then be implemented as enabling an access to a memory position in which the actual data is stored. In an embodiment of an encoder or decoder apparatus, the apparatus comprises at least one computer program product in the form of a non-volatile memory, e.g. an EEPROM, a flash memory and/or a disk drive. The computer program product comprises a computer program comprising code means which run on the processing unit cause the encoder or decoder apparatus, respectively, to perform the steps of the procedures described further above. The code means in the computer program may comprise a module corresponding to each illustrated block. The modules essentially perform the steps of the procedures described further above. In other words, when the different modules are run on the processing unit they correspond to the corresponding blocks in e.g. FIG. 4A, 4B, 9, 12A, 12B and 15.

Although the code means in the embodiment disclosed above are implemented as computer program modules which when run on the processing unit causes the blocks to perform steps of the procedures described further below, at least one of the blocks may in alternative embodiments be implemented at least partly as hardware circuits.

Figure 17:
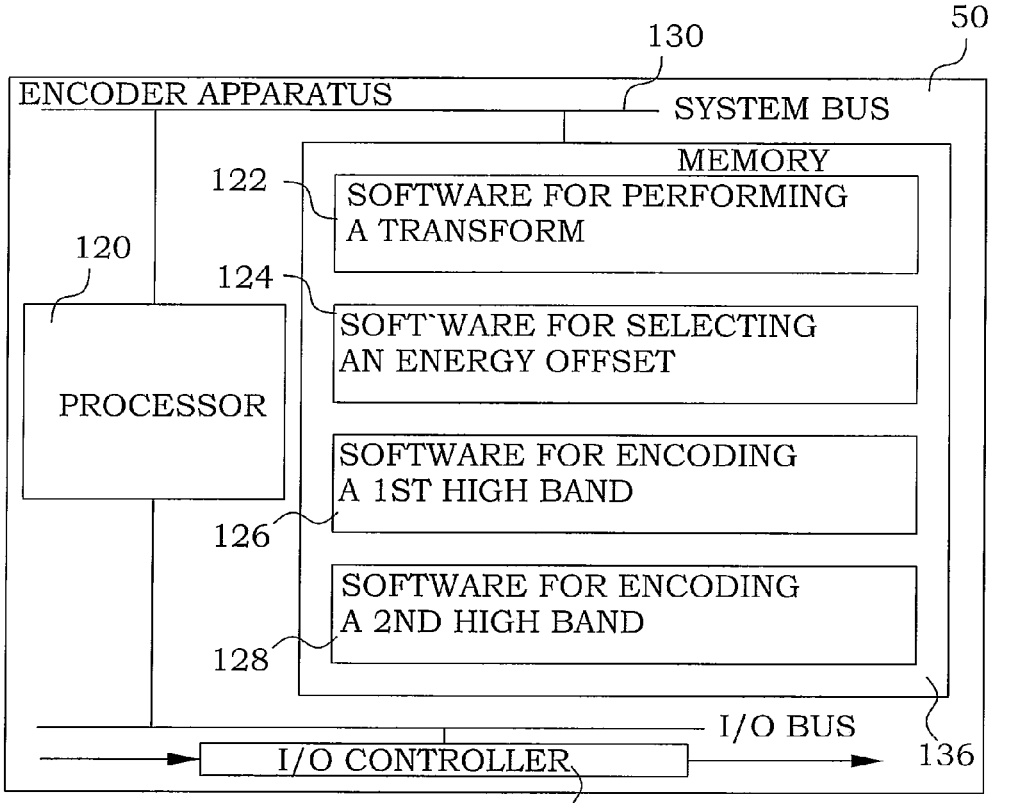
FIG. 17 is a block diagram illustrating an example embodiment of an encoder apparatus.

As an implementation example, FIG. 17 is a block diagram illustrating an example embodiment of an encoder apparatus 50. This embodiment is based on a processor 120, for example a micro processor, a memory 136, a system bus 130, an input/output (I/O) controller 134 and an I/O bus 132. In this embodiment the low band synthesis signal is received by the I/O controller 134 are stored in the memory 136. Likewise, a first energy measure and a second energy measure of the first reference band is received by the I/O controller 134 are stored in the memory 136. In alternative embodiments, the low band synthesis signal and/or the first and second energy measures of the first reference band may be provided by the processor via the system bus 130. The processor 120 executes a software component 122 for performing a transform of the audio signal, a software component 124 for selecting an energy offset, a software component 126 for encoding the first high band and a software component 128 for encoding a second high band. This software is stored in the memory 136. The processor 120 communicates with the memory 136 over the system bus 130. Software component 122 may implement the functionality of block 52 in the embodiments of FIG. 12A or 12B. Software component 124 may implement the functionality of block 58 in the embodiments of FIG. 12A or 12B. Software components 126 and 128 may together implement the functionality of block 55 in the embodiments of FIG. 12A or 12B.

Figure 18:
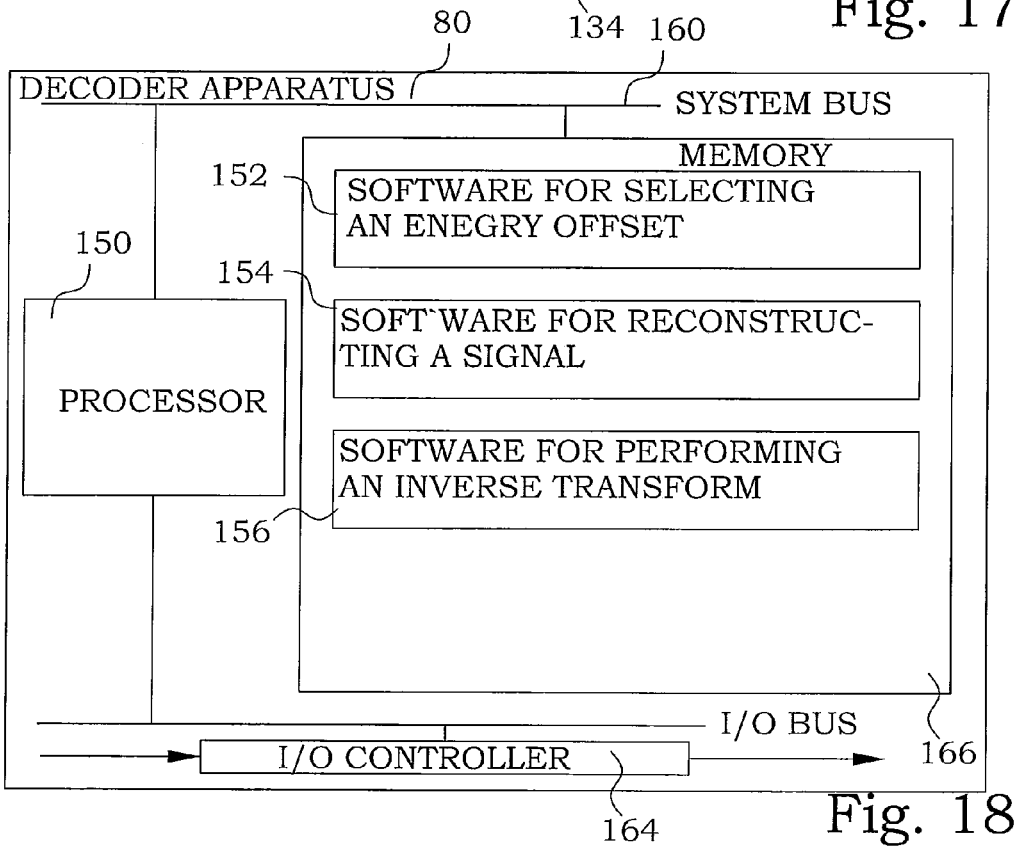
FIG. 18 is a block diagram illustrating an example embodiment of a decoder apparatus.

As an implementation example, FIG. 18 is a block diagram illustrating an example embodiment of a decoder apparatus 80. This embodiment is based on a processor 150, for example a micro processor, a memory 166, a system bus 160, an input/output (I/O) controller 164 and an I/O bus 162. In this embodiment the audio signal and the low band synthesis signal is received by the I/O controller 164 are stored in the memory 166. Likewise, a first energy measure and a second energy measure of the first reference band is received by the I/O controller 164 are stored in the memory 166. In alternative embodiments, the low band synthesis signal and/or the first and second energy measures of the first reference band may be provided by the processor via the system bus 160. The processor 150 executes a software component 152 for selecting an energy offset, a software component 154 for reconstructing a signal in a transform domain and a software component 156 for performing an inverse transform. This software is stored in the memory 166. The processor 150 communicates with the memory 166 over the system bus 160. Software component 152 may implement the functionality of block 88 in the embodiment of FIG. 15. Software component 154 may implement the functionality of block 81 in the embodiment of FIG. 15. Software component 156 may implement the functionality of block 85 in the embodiment of FIG. 15.

Some or all of the software components described above may be carried on a computer-readable medium, for example a CD, DVD or hard disk, and loaded into the memory for execution by the processor.

The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined in other configurations, where technically possible. The scope of the present invention is, however, defined by the appended claims.

ABBREVIATIONS

ACELP—Algebraic Code Excited Linear Prediction
BWE—Bandwidth Extension
CELP—Code-Excited Linear Prediction
MDCT—Modified Discrete Cosine Transform

The invention claimed is:

1. A method, in an audio encoding device, for encoding of an audio signal, the method comprising:

obtaining a low band synthesis signal of an encoding of said audio signal;

obtaining a first energy measure of a first reference band within a low band (LB) in said low band synthesis signal;

performing a transform of said audio signal into a transform domain;

selecting an energy offset from a set of at least two predetermined energy offsets for each of a plurality of first subbands of a first high band (HB-1) of said audio signal in said transform domain, said first high band (HB-1) being situated at higher frequencies than said low band (LB); and encoding said first high band (HB-1), wherein said encoding of said first high band (HB-1) comprises providing a first set of quantization indices representing a respective scalar quantization of a spectrum envelope in said plurality of first subbands of said first high band (HB-1) relative to said first energy measure, said first set of quantization indices being given with a respective said selected energy offset, and wherein said encoding of said first high band (HB-1) further comprises providing a parameter defining the used energy offset;

obtaining a second energy measure of a second reference band within said low band (LB) in said low band synthesis signal; and encoding a second high band (HB-2) of said audio signal in said transform domain, said second high band (HB-2) being situated in frequency between said low band (LB) and said first high band (HB-1), and wherein said encoding of said second high band (HB-2) comprises providing a second set of quantization indices representing a respective scalar quantization of a spectrum envelope in a plurality of second subbands of said second high band (HB-2) relative to said second energy measure.

2. The method of claim 1, wherein said selecting an energy offset is dependent on a power distribution of said audio signal in a frequency domain.

3. The method of claim 1, wherein said selecting an energy offset is based on an open loop procedure, comprising determining a parameter characterizing a power distribution of said low band synthesis signal in a frequency domain, whereby said selecting is based on said determined parameter.

4. The method of claim 1, wherein said encoding in turn comprises providing one first set of said quantization indices for each predetermined energy offset range; and said selecting an energy offset in turn comprises:

calculating a quantization error for each of said first sets of quantization indices; and selecting the first set of said quantization indices that gives the smallest quantization error.

5. The method of claim 1, wherein said transform encoding is a Modified Discrete Cosine Transform.

6. The method of claim 1, wherein a low frequency end of said first high band (HB-1) is 8 kHz.

7. The method of claim 1, wherein a high frequency end of said first high band is (HB-1) 11.6 kHz.

8. The method according claim 1, wherein said first high band (HB-1) comprises five first subbands.

9. The method of claim 1, wherein said low band (LB) ranges from 0-6.4 kHz.

10. The method of claim 1, wherein said first reference band comprises entire said low band (LB).

11. The method of claim 1, wherein said first reference band ranges from 0-5.9 kHz.

12. The method of claim 1, wherein said low band synthesis signal is based on an encoding by a Code-Excited Linear Prediction encoder.

13. The method of claim 1, wherein the quantization indices of said second set of quantization indices are restricted in increased energy direction.

14. The method of claim 13, wherein said energy restriction of said quantization indices is reduced with increasing frequency of said second subbands.

15. The method of claim 1, wherein said second high band (HB-2) ranges between 6.4 and 8 kHz.

16. The method of claim 1, wherein said second reference band ranges between 5.9 and 6.4 kHz.

17. The method of claim 1, wherein said second high band (HB-2) comprises three second subbands.

18. A method, in an audio decoding device, for decoding of an audio signal, the method comprising:

receiving an encoding of said audio signal, said encoding representing a first set of quantization indices of a spectrum envelope in a plurality of first subbands of a first high band (HB-1) of said audio signal, said first set of quantization indices representing energies relative to a first energy measure, said encoding further representing a parameter defining a used energy offset, wherein said encoding further represents a second set of quantization indices of a spectrum envelope in a plurality of second subbands of a second high band (HB-2) of said audio signal, said second set of quantization indices representing energies relative to a second energy measure;

obtaining a low band synthesis signal of an encoding of said audio signal;

obtaining said first energy measure as an energy measure of a first reference band within a low band (LB) in said low band synthesis signal, said first high band (HB-1) being situated at higher frequencies than said low band (LB) and said second high band (HB 2) being situated in frequency between said low band (LB) and said first high band (HB-1);

selecting an energy offset from a set of at least two predetermined energy offsets for each of said first subbands based on said parameter defining said used energy offset;

reconstructing a signal in a transform domain by determining a spectrum envelope in said first high band (HB-1) from said first set of quantization indices corresponding to said first subbands, by use of said selected energy offset and said first energy measure, for each of said first subbands of said first high band (HB-1); and performing an inverse transform based on at least said reconstructed signal in said transform domain into said audio signal;

obtaining said second energy measure as an energy measure of a second reference band within said low band (LB) in said low band synthesis signal; and wherein said reconstructing said signal in said transform domain further comprises determining a spectrum envelope in said second high band (HB-1) from said second set of quantization indices corresponding to said second subbands by use of said second energy measure for each of said second subbands of said second high band (HB-2).

19. The method of claim 18, wherein said transform encoding is a Modified Discrete Cosine Transform.

20. The method of claim 18, wherein a low frequency end of said first high (HB-1) band is 8 kHz.

21. The method of claim 18, wherein a high frequency end of said first high (HB-1) band is 11.6 kHz.

22. The method of claim 18, wherein said first high (HB-1) band comprises five first subbands.

23. The method of claim 18, wherein said low band (LB) ranges from 0-6.4 kHz.

24. The method of claim 18, wherein said first reference band comprises entire said low band (LB).

25. The method of claim 18, wherein said first reference band ranges from 0-5.9 kHz.

26. The method of claim 18, wherein said low band synthesis signal is based on an encoding by a Code-Excited Linear Prediction encoder.

27. The method of claim 18, wherein the quantization indices of said second set of quantization indices are restricted in increased energy direction.

28. The method of claim 27, wherein said energy restriction of said quantization indices is reduced with increasing frequency of said second subbands.

29. The method of claim 18, wherein said second high band (HB-2) ranges between 6.4 and 8 kHz.

30. The method of claim 18, wherein said second reference band ranges between 5.9 and 6.4 kHz.

31. The method of claim 18, wherein said second high band (HB-2) comprises three second subbands.

32. An encoder apparatus for encoding of an audio signal, comprising:

a transform encoder configured to perform a transform of said audio signal into a transform domain;

a selector configured to select an energy offset from a set of at least two predetermined energy offsets for each of a plurality of first subbands of a first high band (HB-1) of said audio signal in said transform domain;

a synthesizer configured to obtain a low band synthesis signal of an encoding of said audio signal;

an energy reference block, connected to said synthesize and configured to obtain a first energy measure of a first reference band within a low band (LB) in said low band synthesis signal, said first high band HB-1) being situated at higher frequencies than said low band (LB);

an encoder block, connected to said selector and said energy reference block and configured to encode said first high band (HB-1) so as to provide a first set of quantization indices representing a respective scalar quantization of a spectrum envelope in said plurality of first subbands of said first high band (HB-1) relative to said first energy measure, said first set of quantization indices being given with a respective said selected energy offset, and so as to provide a parameter defining the used energy offset;

wherein said energy reference block is further configured to obtain a second energy measure of a second reference band within said low band (LB) of said low band synthesis signal;

wherein said encoder block is further configured to encode a second high band (HB-2) of said audio signal in said transform domain, said second high band (HB-2) being situated in frequency between said low band (LB) and said first high band (HB-1), wherein said encoder block is configured to encode the second high band (HB-2) so as to provide a second set of quantization indices representing a respective scalar quantization of a spectrum envelope in a plurality of second subbands of said second high band (HB-2) relative to said second energy measure.

33. The encoder apparatus of claim 32, wherein said selector is configured to select an energy offset in dependence on a power distribution of said audio signal in a frequency domain.

34. The encoder apparatus of claim 32, wherein said selector is configured to determine a parameter characterizing a power distribution of said low band synthesis signal in a frequency domain and to select an energy offset based on said determined parameter.

35. The encoder apparatus of claim 32, wherein said encoder block is configured to provide one first set of said quantization indices for each predetermined energy offset range; and said selector is configured to receive said first sets of quantization indices for all predetermined energy offset ranges and comprises a calculation block configured to calculate a quantization error for each of said first sets of quantization indices and a selection block configured to select the first set of said quantization indices giving the smallest quantization error.

36. The encoder apparatus of claim 32, wherein said transform encoder is a Modified Discrete Cosine Transform encoder.

37. A network node comprising the encoder apparatus of claim 32.

38. A decoder apparatus for decoding of an audio signal, the decoder apparatus comprising:

an input block configured to receive an encoding of said audio signal, said encoding representing a first set of quantization indices of a spectrum envelope in a plurality of first subbands of a first high band (HB-1) of said audio signal, said first set of quantization indices representing energies relative to a first energy measure, said encoding further representing a parameter defining a used energy offset, said encoding further representing a second set of quantization indices of a spectrum envelope in a plurality of second subbands of a second high band (HB-2) of said audio signal, said second set of quantization indices representing energies relative to a second energy measure;

a synthesizer configured to obtain a low band synthesis signal of an encoding of said audio signal;

an energy reference block, connected to said synthesizer and configured to obtain said first energy measure as an energy measure of a first reference band within a low band (LB) in said low band synthesis signal, said first high band (HB-1) being situated at higher frequencies than said low band (LB) and said second high band (HB-2) being situated in frequency between said low band (LB) and said first high band (HB-1);

a selector, connected to said input block and configured to select an energy offset from a set of at least two predetermined energy offsets for each of said first subbands based on said parameter defining said used energy offset;

a reconstruction block, connected to said input block, said selector, and said energy reference block, and configured to reconstruct a signal in a transform domain by determining a spectrum envelope in said first high band (HB-1) from said first set of quantization indices corresponding to said first subbands, by use of said selected energy offset and said first energy measure, for each of said first subbands of said first high band (HB-1); and an inverse transform decoder, connected to said reconstruction block and configured to perform an inverse transform based on at least said reconstructed signal in said transform domain into said audio signal;

wherein said energy reference block is further configured to obtain said second energy measure as an energy measure of a second reference band within said low band (LB) of said low band synthesis signal; and wherein said reconstruction block is further configured to determine a spectrum envelope in said second high band (HB-1) from said second set of quantization indices corresponding to said second subbands by use of said second energy measure for each of said second subbands of said second high band (HB-2).

39. The decoder apparatus of claim 38, wherein said inverse transform decoder is a Modified Discrete Cosine inverse Transform decoder.

40. A network node comprising the decoder apparatus of claim 38.

* * * * *